US011591773B2

(12) United States Patent
Pawar et al.

(10) Patent No.: US 11,591,773 B2
(45) Date of Patent: Feb. 28, 2023

(54) INTELLIGENT ASSIST SYSTEM FOR A WORK MACHINE

(71) Applicant: Deere & Company, Moline, IL (US)

(72) Inventors: Sanket Pawar, Pune (IN); Antony Raj, Pune (IN); Jeffery R. Kreiling, Benton, WI (US); Senthil Mohan N S, Pune (IN); Saravanan Stallin, Pune (IN); Adam J. Eisbach, Dubuque, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 17/447,875

(22) Filed: Sep. 16, 2021

(65) Prior Publication Data

US 2022/0002973 A1 Jan. 6, 2022

Related U.S. Application Data

(63) Continuation of application No. 16/280,777, filed on Feb. 20, 2019, now abandoned.

(51) Int. Cl.

| | |
|---|---|
| ***E02F 9/20*** | (2006.01) |
| ***E02F 3/36*** | (2006.01) |
| ***E02F 3/34*** | (2006.01) |

(52) U.S. Cl.

CPC ..... *E02F 9/2062* (2013.01); *E02F 3/3414* (2013.01); *E02F 3/3622* (2013.01)

(58) Field of Classification Search

CPC ..... E02F 9/2062

See application file for complete search history.

(56) References Cited

U.S. PATENT DOCUMENTS

| | | | | |
|---|---|---|---|---|
| 8,644,964 | B2 | 2/2014 | Hendron et al. | |
| 9,163,387 | B2 * | 10/2015 | Yuan | F15B 19/002 |
| 10,253,481 | B2 * | 4/2019 | Katou | G09B 29/00 |
| 10,344,449 | B2 * | 7/2019 | Wagner | E02F 9/0841 |
| 10,480,541 | B2 * | 11/2019 | Bellows | F15B 13/06 |
| 10,889,962 | B2 * | 1/2021 | Michael Raj | E02F 3/3414 |
| 2004/0074563 | A1 | 4/2004 | MacNeil et al. | |
| 2016/0222623 | A1 | 8/2016 | Wagner | |
| 2019/0010966 | A1 | 1/2019 | Bellows et al. | |

FOREIGN PATENT DOCUMENTS

| | | | |
|---|---|---|---|
| EP | 3199711 | A2 | 8/2017 |
| JP | 2016176298 | A | 10/2016 |
| WO | WO2017128272 | A1 | 8/2017 |

* cited by examiner

*Primary Examiner* — Michael A Berns

(57) ABSTRACT

A work machine controller that is coupled to the boom assembly may comprise of a controller with a memory that stores computer-executable instructions and a processor that executes instructions. The instructions include monitoring a first position signal from the first boom position sensor, a second position signal from the second boom position sensor, the load signal, and the orientation signal. The instructions then include calculating a load vector based on the load signal and the orientation signal, generating a disorientation signal based on the load vector and a direction of travel, determining if the disorientation signal is outside a predetermined threshold, and actuating one or more of the actuators and the ground-engaging mechanism to reorient the load when the disorientation signal exceeds the predetermined threshold.

20 Claims, 18 Drawing Sheets

INTELLIGENT ASSIST SYSTEM FOR A WORK MACHINE

CROSS-REFERENCE TO RELATED APPLICATIONS

This application is a continuation-in-part of U.S. patent application Ser. No. 16/280,777 filed Feb. 20, 2019 and titled "Intelligent Mechanical Linkage Performance System", the disclosure of which is hereby incorporated by reference in its entirety.

FIELD OF THE DISCLOSURE

The present disclosure relates to a work machine.

BACKGROUND

In the forestry industry, for example, grapple skidders may be used to transport harvested standing trees from one location to another. This transportation typically occurs from the harvesting site to a processing site. Alternatively, in the construction industry, excavators may be used to transport gravel, dirt, or other movable material. In both work machines, an implement for carrying a payload is coupled to a boom assembly that includes multiple pivoting means. Actuators may then be arranged on the boom assembly to pivot the booms relative to each other and thereby move the implement.

When multiple booms are arranged in a boom assembly, controlled movement of the implement may be relatively difficult, requiring significant investment in operator training. This can be especially difficult to maneuver with the variable payloads and physical limitations of the actuators. Under conventional control systems, for example, an operator may move a joystick along one axis to move one more actuators that pivot a first boom section, and move the joystick along another axis to move actuators that pivot a second boom section. In theory, an operator may control the two boom sections such that the aggregate movement of all the actuators causes desired movement of the implement carrying a payload to a desired position. However, dependent upon the orientation of the payload, directional pull of the payload, and the changing geometry of the two booms as they move relative to each other and the vehicle, the changing geometry introduces significant complexity to the relationships between actuator movement and movement of the implement. In the exemplary embodiment of the skidder, logs are generally dragged along the surface in a rugged area. This may result in large forces in the X, Y, and Z directions and an additional torsional force not found in other work machines.

Movement of the boom can vary dramatically based upon the location of boom assembly components with respect to the work machine frame and the travel direction. Moreover, movement of the boom assembly can vary dramatically based on the incline of the surface a work machine is situated because it changes the relative orientation of the downward gravitational pull of the payload and/or implement relative to the directional pull of the actuators coupled to the boom assembly. This variability in the payload's orientation ultimately makes it difficult for a user to accurately assess optimal boom operation, especially when traversing the work machine through rugged terrain, and substantially more so if operated remotely. Therein lies an opportunity for an improved control system for moving payloads that can account for these variables when at a worksite.

SUMMARY

This summary is provided to introduce a selection of concepts that are further described below in the detailed description and accompanying drawings. This summary is not intended to identify key or essential features of the appended claims, nor is it intended to be used as an aid in determining the scope of the appended claims.

The present disclosure includes a work machine having a dynamic assist system, and method of using this system to adjust the position of the grapple relative to the frame of the work machine.

According to an aspect of the present disclosure, a work machine may include a frame, a ground-engaging mechanism configured to support the frame on a surface, a boom assembly, a load measuring device, an angle measuring device, and a controller. The boom assembly, coupled to the frame of the work machine, may include a first section pivotally coupled to the frame and moveable relative to the frame by a first actuator, a second section pivotally coupled to the first section and moveable relative to the first section, and a grapple pivotally suspended from the second section at a location distal from the first section. The grapple is rotatable relative to the frame by a third actuator and is configured to engage a payload. A first boom position sensor may be coupled to the first section. A second boom position sensor may be coupled to the second section. The load measuring device may be coupled to the boom assembly and configured to generate a load signal indicative of a payload. The angle measuring device is coupled to the boom assembly and the grapple wherein the angle measuring device is configured to generate an orientation signal indicative of an orientation of the payload relative to the frame. A controller that is coupled to the boom assembly may comprise of a memory that stores computer-executable instructions and a processor that executes instructions. The instructions include monitoring a first position signal from the first boom position sensor, a second position signal from the second boom position sensor, the load signal, and the orientation signal. The instructions then include calculating a load vector based on the load signal and the orientation signal, generating a disorientation signal based on the load vector and a direction of travel, determining if the disorientation signal is outside a predetermined threshold, and actuating one or more of the actuators and the ground-engaging mechanism to reorient the load when the disorientation signal exceeds the predetermined threshold.

The work machine may further comprise of a pin coupled to the second section at a location distal from the first section wherein the pin may have an envelope of movement throughout which the pin is moveable. The controller may further calculate a map of hydraulic capacities with an envelope of movement for one or more of the first and second actuators based on the first position signal, the second position signal, the load signal, and the orientation signal. The controller may further generate a movement envelope of movement of the pin through at least a portion of the envelope based on the hydraulic capacities, the movement envelope being smaller than the envelope.

The map of hydraulic capacities may comprise of a series of nodes representing the hydraulic capacities of one or more of the first and the second actuators through the envelope in real-time.

The movement envelope may comprise of a lift path of the pin from a first pin position to a second pin position through nodes with sufficient hydraulic capacity.

The controller may actuate a change in one or more of a travel speed and a travel path if the disorientation signal exceeds a predetermined threshold.

The predetermined threshold comprises of first threshold actuating a first response, and a second predetermined threshold actuating a second response.

The controller may initiate an alert when the load vector is located external to a predetermined area.

The work machine may further comprise of a communication portal for communicatively coupling the controller with a remote controller, wherein an operator may view the disorientation signal on a display and actuate one or more of the first actuator, the second actuator, the third actuator and the ground-engaging mechanism to maintain alignment of the payload within the predetermined threshold.

The grapple suspension coupling comprises of a crosshead assembly that includes a boom stopper for limiting a free-range motion of the suspended grapple.

Alternatively, the controller may calculate a load vector based on the first rotation angle signal, the second rotation angle signal, and the load signal. The controller then determines if the load vector falls outside predetermined limits in one or more of the x, y, and z direction, and performs some action based on this load vector. The action may comprise of actuating the arch actuators to extend or retract the grapple, actuate the boom actuators to raise or lower the grapple, and actuate the grapple actuator to rotate the grapple. The action may further include modifying the speed or travel path of the work machine and alerting the operator.

The method may include monitoring a grapple position relative to a frame of the work machine; monitoring a grapple orientation relative to the frame of the work machine, monitoring a direction of travel of the work machine, calculating a load vector of the payload on the work machine, determining the orientation of the load vector relative to the direction of travel, selecting a countermeasure to align the load vector with the direction of travel within a predetermined range, and executing the countermeasure.

The countermeasure may include raising or lowering the boom assembly relative to the frame; extending or retracting the boom assembly relative to the frame; rotating a grapple orientation relative to the frame; changing a speed of travel of the work machine; changing a path of travel of the work machine; and alerting the operator if the load vector exceeds a predetermined range.

These and other features will become apparent from the following detailed description and accompanying drawings, wherein various features are shown and described by way of illustration. The present disclosure is capable of other and different configurations and its several details are capable of modification in various other respects, all without departing from the scope of the present disclosure. Accordingly, the detailed description and accompanying drawings are to be regarded as illustrative in nature and not as restrictive or limiting.

BRIEF DESCRIPTION OF THE DRAWINGS

The detailed description of the drawings refers to the accompanying figures in which.

DETAILED DESCRIPTION

The following describes one or more example implementations of the disclosed system for intelligent control of the implement, as shown in the accompanying figures of the drawings. Generally, the disclosed control system (and work machines on which they are implemented) allow for improved operator control of the movement of the implement as compared to conventional systems.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

Figure 1:
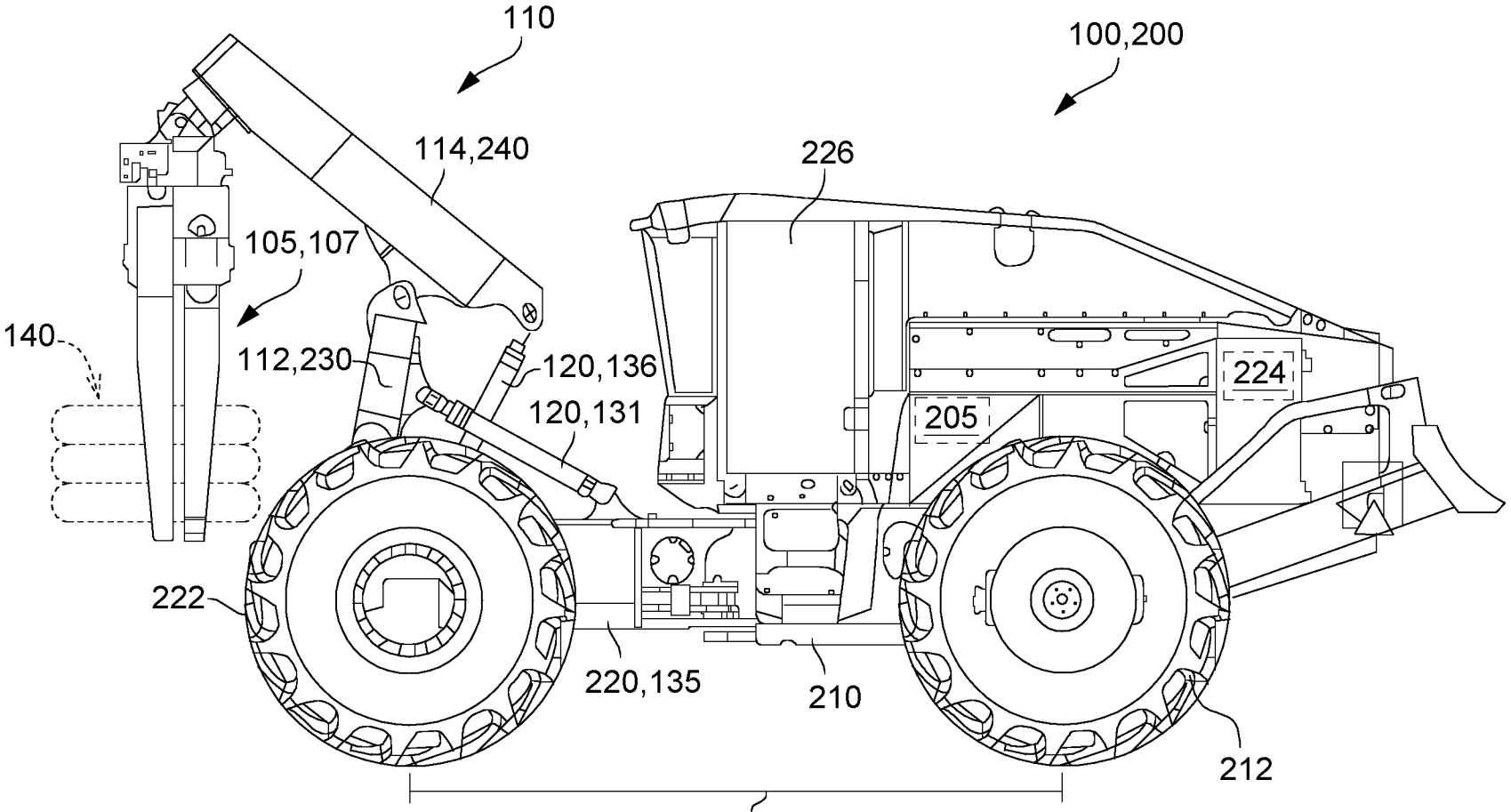
FIG. 1 is a side view of a first exemplary embodiment of a work machine having an intelligent mechanical linkage performance system.
Figure 10:
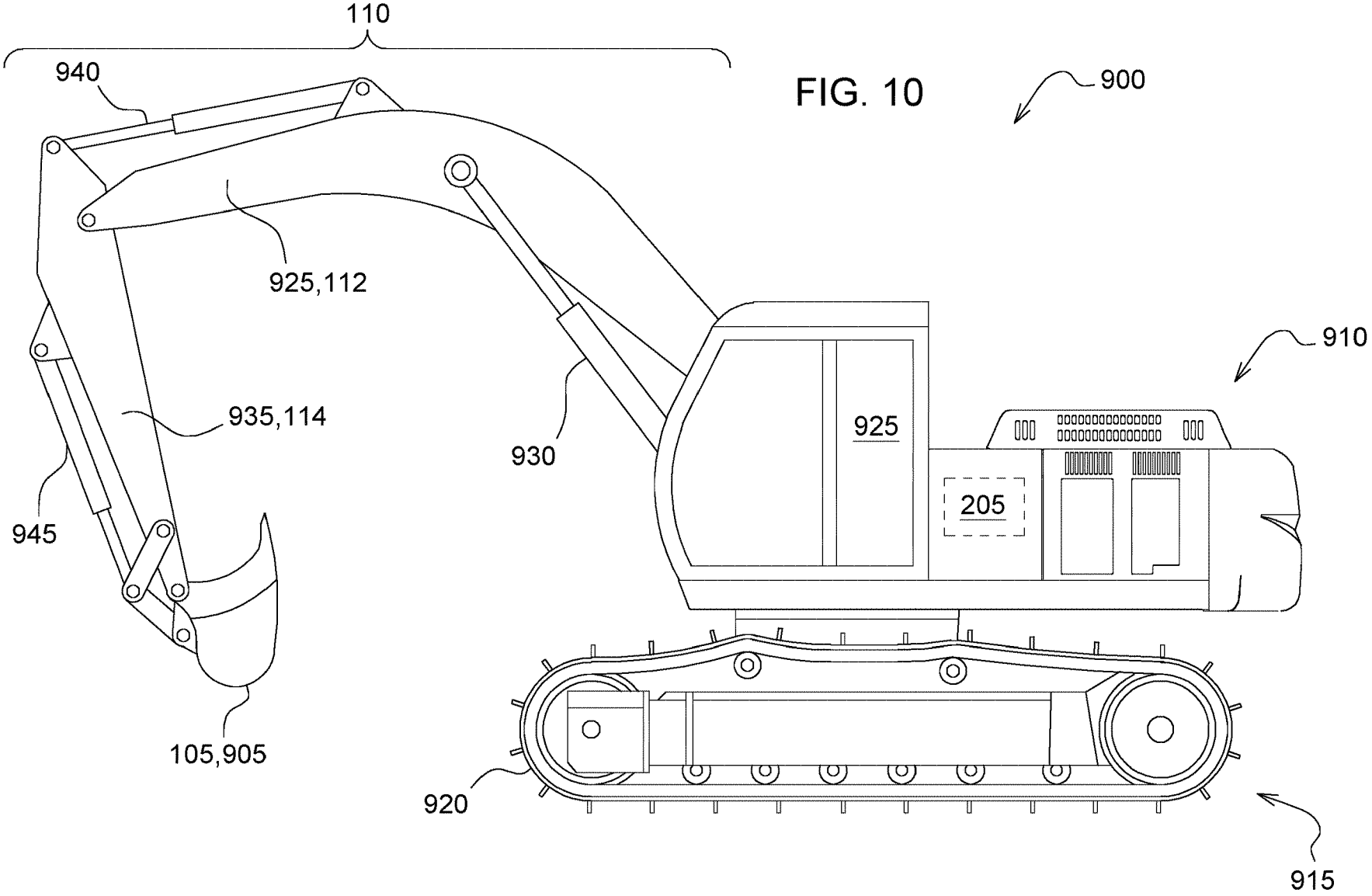
FIG. 10 is a side view of a second exemplary embodiment of a work machine having an intelligent mechanical linkage performance system.

Referring now to the drawings and with specific reference to FIG. 1, an implement 105 may be coupled to a work machine 100 by a boom assembly 110 and the boom assembly 110 may be moved by various actuators 120 to accomplish tasks with the implement 105. Note that actuators 120 may be electric or hydraulic. Although, hydraulic cylinder is repeatedly referenced throughout, an electric actuator may be interchangeable with a hydraulic actuator. Discussion herein may sometimes focus on the example application of moving an implement 105 wherein the work machine 100 is configured as a grapple skidder 200 in a first exemplary embodiment (as shown in FIG. 1) and configured as an excavator 900 (as shown in FIG. 10) in a second exemplary embodiment, with actuators 120 generally configured as hydraulic cylinders 125 for moving an implement 105. In the instance of a grapple skidder 200 as shown in FIG. 1, a grapple 107 is used for moving a payload 140. Grapple skidders 200 are generally used to move forestry related payloads such as felled trees and processed logs with use of an implement 105, the grapple 107, wherein the grapple may mimic pincher type movement. In the instance of an excavator 900, as shown in FIG. 10, a bucket 905 is used for moving a payload 140. In other applications, other configurations are possible. In some embodiments, for example, forks, felling heads or other implements with a payload carrying capacity may also be configured in other boom assembly configurations. With respect to the present disclosure, work machines in some embodiments may be configured as diggers, forwarders, loaders, feller bunchers, concrete crushers and similar machines, or various other embodiments.

As shown in FIGS. 2 through 8, with continued reference to FIG. 1, the disclosed intelligent mechanical linkage performance system 300 may be used to receive position signals 305 of an implement 105 based on real-time positions of the actuators 120 relative to a frame 130, and load signals 288 of the payload 140 carried by the implement 105 based on a real-time load sensed. In the present disclosure frame 135 may be shown as the frame of the work machine 100. However, the frame 130 may also be an arbitrary point on the work machine 100 or in the digital/electronic space to create a point(s) by which the relative positions of the actuators 120 may be measured. For example, in a hydraulic actuator it may be the relative position of the cylinder along the length of the rod.

The intelligent mechanical linkage performance system 300 may then determine position commands for various actuators 120 such that the commanded movement of the actuators 120 provides an optimal pathway (hereinafter referred to as a lift path 710) of commanded movement of the implement 105 depending on the theoretical load capacity of each respective actuator 120 along various positions within an envelope 400 of movement, and actual load requirements for moving the payload 140 from a first position 720 in envelope of movement 400 to a second position 730 in envelope of movement 400 relative to the frame 130. Note that the first position 720 and the second position 730 are not predefined positions. Rather the first position may be a current position or starting position of the boom assembly within or along the perimeter 312 (shown with dotted line) of the envelope of movement 400 where the grapple 107 may have at that instant or before engaged with a payload 140. The second position 730 may be a desired position within or along the perimeter 312 of the envelope of movement 400. The second position 730 in grapple skidder may be a transport position where the grapple 107 has sufficiently lifted the payload 140 (most likely a group of felled trees) to be either lifted off the ground or dragged to its next destination.

The envelope of movement 400 of movement may be defined by the range of possible movement of the distal end 115 of the boom assembly 110 where an implement 105 may be coupled. This perimeter 312 of the envelope of movement 400 is defined by one or more hydraulic cylinders 125 coupled to the boom assembly 110 being at a fully extended or retracted position. In this way, optimized planned movement along a limited pathway in the envelope of movement 400 may be converted to position commands for the relatively complex movement of multiple actuators 120, providing optimal movement of the implement 105 with the given payload 140. This advantageously reduces reliance on an operator's perception or the operator's expertise in that an operator may directly indicate a desired movement for the payload 140 with respect to at least one actuator 120 towards the second position 730 and the intelligent mechanical linkage performance system 300 maps a suggested lift path 710 (i.e. planned movement along a limited pathway through the envelope of movement 400) for subsequent actuators 120 relative to frame 130 based on the payload 140. The available capacity from the hydraulic system 310 may be determined primarily by remaining rod length in a hydraulic cylinder. However, hydraulic fluid volume, actuator pressure, disposition of the valves within the hydraulic system, architecture of the system such as closed loop systems or open loop systems, are a few other possible variables that may factor into available capacity calculations. Each of these may individually or summarily indicate the position of the actuator 120.

The lift path 710 defines portions of the envelope of movement 400 wherein each respective actuator 120 has sufficient available capacity to move the measured payload 140. For example, an instance may occur where retracting one actuator 120 may leave insufficient rod length for a subsequent actuator to provide the pull or lift force needed to move the payload 140. With the intelligent mechanical linkage performance system 300, an operator may cause relatively precise movement of each respective actuator 120 with the detailed guide for movement of an individual actuator 120 and as a result the implement 105, in the envelope of movement 400, or possibly mapping of a lift path 710 within the envelope of movement 400. Alternatively, the control may restrict movement of the actuators and/or pin 215 to a movement envelope wherein the movement envelope is smaller than the envelope of movement 400. In a semi-automatic control mode 365, the intelligent mechanical linkage performance system 300 merely provides guidance to the operator with visual and/or haptic feedback.

By way of applying the above to a grapple skidder 200, the intelligent mechanical linkage performance system 300 may function in an automatic mode 375 wherein the operator may cause movement of a first section 112 of a boom assembly 110 and the controller 255 may respond by automatically moving the respective actuator(s) 120 of a second section 114 of the boom assembly 110 and therefore the implement 105, in the envelope 400 of movement, or mapping of a lift path 710 within the envelope 400 from the first position 720 to the second position 730.

Generally, a boom assembly 110 may include at least two sections that are separately movable by different respective actuators 120. For example, a first section 112 of a boom assembly 110 may be coupled to a frame 135 of the work machine 100, and may be moved (e.g. pivoted) relative to the frame 135 of the work machine 100 by a first actuator 131. A second section of the boom assembly 114 may be coupled to the first section 112 of the boom assembly 110, and may be moved (e.g. relative to the first section 112 by a second actuator 136). An implement 105 may be coupled to the second section 114 and, in some embodiments, may be moved (e.g. pivoted) relative to the second section 114 by a third actuator 945 (e.g. as shown in FIG. 10). In this way, movements of the first 131, second 136, and possibly the third actuator 945 may correspond to distinct movements of the first section 112 of the boom assembly 110, the second section 114 of the boom assembly 110, and an implement 105, respectively. Further, due to the configuration of the boom assembly 110, a movement of the first section 112 may cause a corresponding movement of the second section 114 and the implement 105 relative to the frame 135 of the work machine 100, and a movement of the second section 114 may cause a corresponding movement of the implement 105 relative to the first section 112 and/or the frame 135 of the work machine 100.

Figure 2:
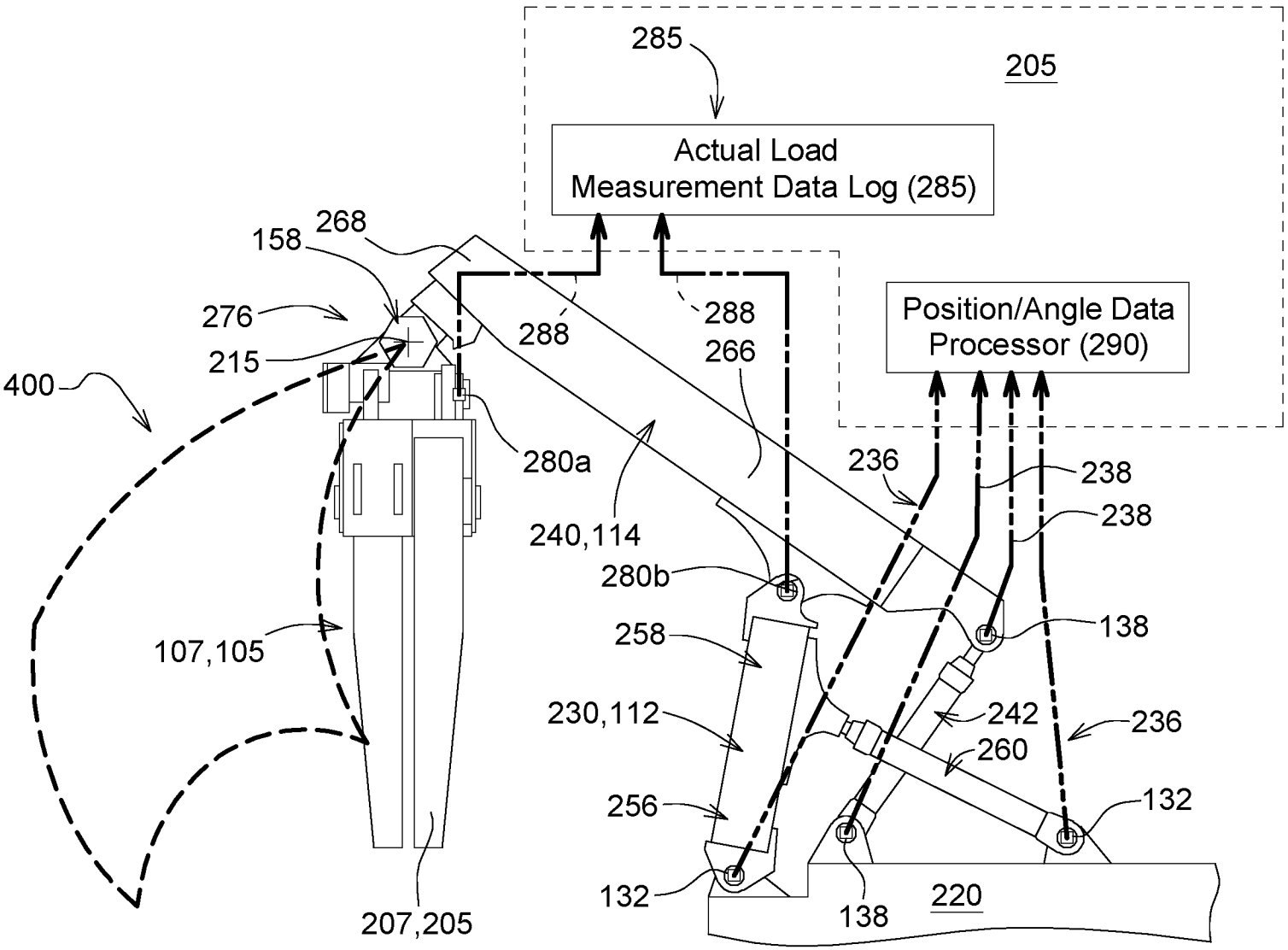
FIG. 2 is a detailed side view of the boom assembly of the first exemplary embodiment shown in FIG. 1 as it relates to a portion of the intelligent performance control module.
Figure 8:
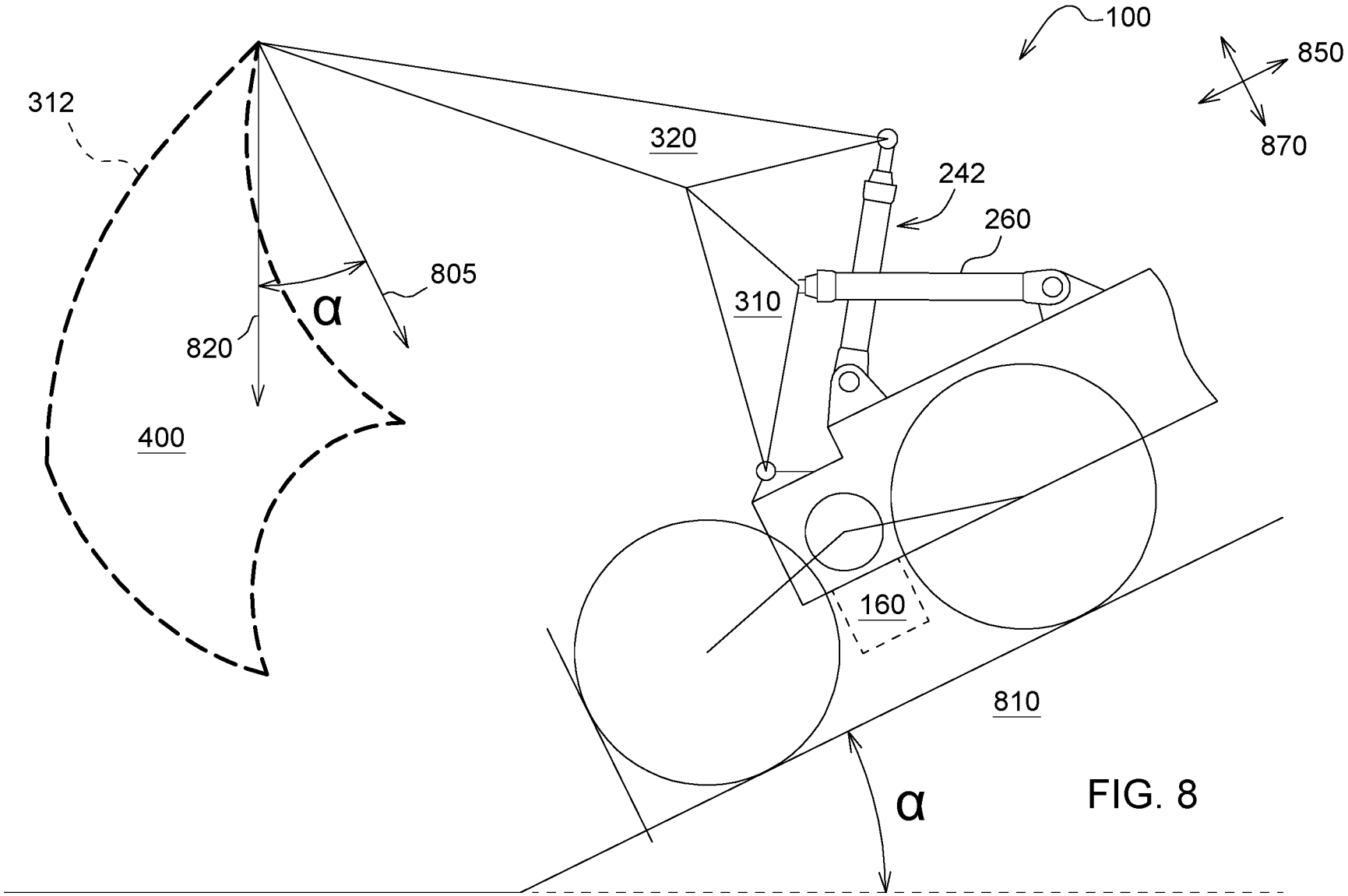
FIG. 8 is a line schematic of the first exemplary embodiment demonstrating the effect of an incline on the intelligent mechanical linkage performance system.

Now referring to FIGS. 1 and 2, the grapple skidder 200 (also referred to herein as "skidder"), having an intelligent mechanical linkage performance system 300 (as shown in FIGS. 2 and 8) is shown. A skidder 200 may be used to transport harvested trees over natural grounds such as a forest. Please note that while the figures and descriptions may relate to a four-wheeled skidder in this first exemplary embodiment, it is to be understood that the scope of the present disclosure extends beyond a four-wheeled skidder as noted above and may include a six-wheeled skidder, or some other vehicle, and the term "work machine" or "vehicle" may also be used. The term "work machine" is intended to be broader and encompass other work machines besides a skidder 200 such as the second exemplary embodiment of an excavator discussed later.

The skidder 200 includes a front vehicle frame 210 coupled to a rear vehicle frame 220. Front wheels 212 support the front vehicle frame 210, and the front vehicle frame 210 supports an engine compartment 224 and operator cab 226. Rear wheels 222 support the rear vehicle frame 220, and the rear vehicle frame 220 supports a boom assembly 110. Although the ground-engaging mechanism is described as wheels in this embodiment, in an alternative embodiment, tracks or combination of wheels and tracks may be used. The engine compartment 224 houses a vehicle engine or motor, such as a diesel engine which provides the motive power for driving the front and rear wheels (212, 222) and for operating the other components associated with the skidder 200 such as the actuators 120 to move the boom assembly 110. The operator cab 226, where an operator sits when operating the work machine 100, includes a plurality of controls (e.g. joysticks, pedals, buttons, levers, display screens, etc.) for controlling the work machine 100 during operation thereof.

The boom assembly 110 is coupled to the frame 135. In the embodiment of a skidder 200, the frame 135 may comprise one or more of the front vehicle frame 210, the rear vehicle frame 220, and/or an arbitrary coordinate system assigned (not shown) stored in the controller 205. In the embodiment disclosed herein, the frame 135 is noted as the rear vehicle frame 220, for simplicity. The boom assembly 110 comprises a first section 112 (i.e. arch section 230) pivotally coupled to the frame 135 and moveable relative to the frame 135 by a first actuator 131 wherein a first boom position sensor 132 is coupled to the first section of the boom assembly 112. The first boom position sensor 132 may comprise of one or more sensors indicating the position of the first section 112. The detailed view of the portion of the first exemplary embodiment in FIG. 2 shows that the first boom position sensor 132 comprises of multiple sensors strategically positioned.

The boom assembly 110 further comprises a second section 114 (i.e. the boom section 240) pivotally coupled to the first section 112 and moveable relative to the first section 112 by a second actuator 136 wherein a second boom position sensor 138 is coupled to the second section 114. The second boom position sensor 138 may comprise of one or more sensors indicative of the position of the second section 114. The second boom position sensor 138 also comprises of multiple sensors strategically positioned.

The locations of position sensors may depend on the linkage kinematics of the boom assembly 110 or components engaging the boom assembly 110 of a respective work machine 100 as well as the type of position sensor. The position sensors (132, 138) feed first and second position signals (236, 238) into the position/angle data processor 290.

Figure 9:
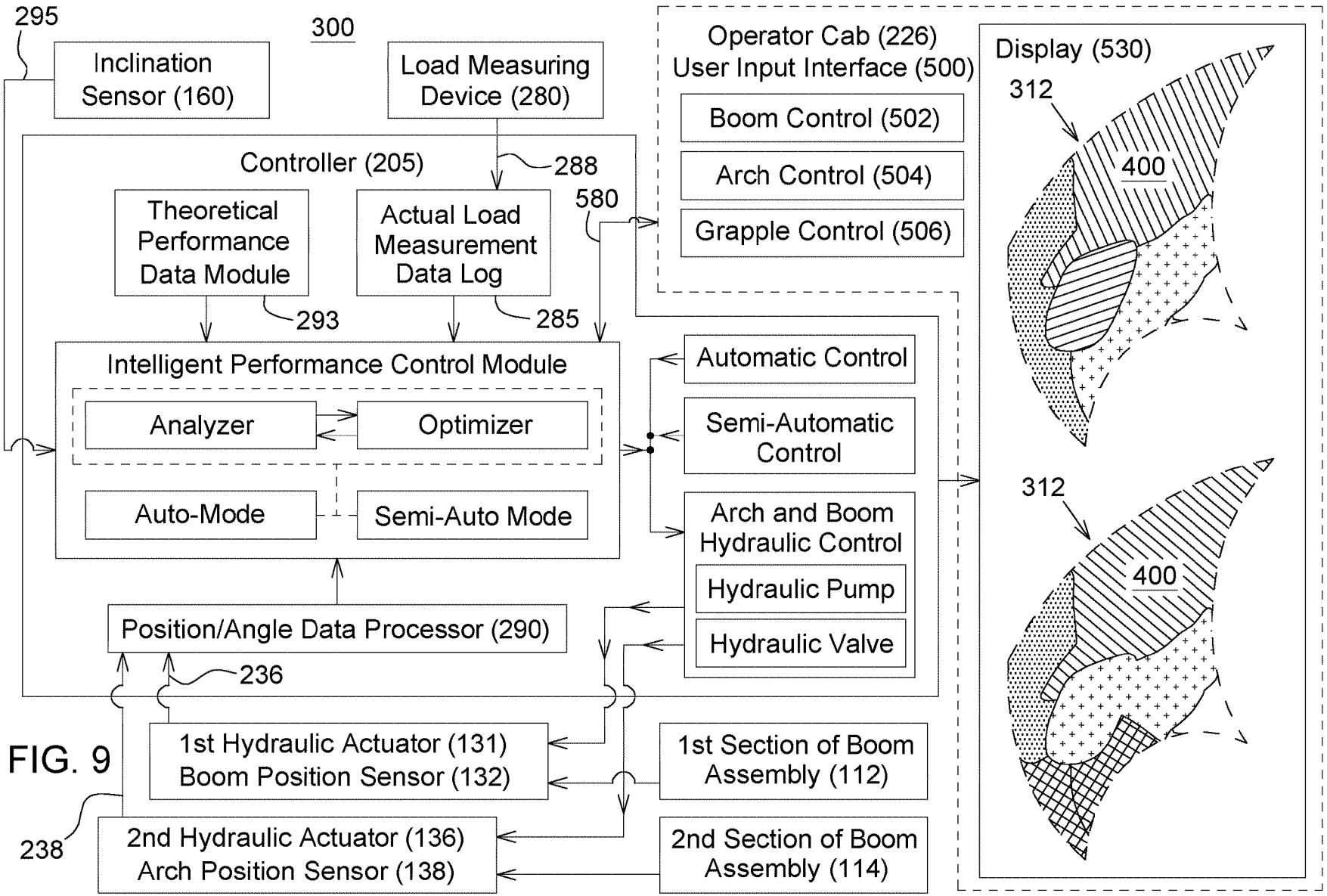
FIG. 9 is a detailed schematic of the intelligent mechanical linkage performance system as it relates to the first exemplary embodiment in FIG. 1.

FIG. 2 details a schematic of the boom assembly 110 of a skidder 200 as it relates to the controller 205 of the skidder in the intelligent mechanical linkage performance system 300 (also detailed in FIG. 9). As previously noted, the boom assembly 110 includes an arch section 230 (i.e. the first section 112 of the boom assembly 110) coupled to the rear vehicle frame 220, a boom section 240 (the second section 114 of the boom assembly 110) coupled to the arch section 230, and a grapple 207 (the implement 105). A proximal end 256 of the arch section 230 is pivotably coupled to the rear vehicle frame 220 and a distal end 258 of the arch section 230 is pivotably coupled to the boom section 240. In this particular embodiment, one or more arch hydraulic cylinders 260 are controllable by the operator to move the arch section 230. A proximal portion 266 of the boom section 240 is pivotably coupled to the arch section 230 and a distal portion 268 of the boom section 240 is pivotably coupled to the grapple 207. One or more boom hydraulic cylinder(s) 242 are coupled to the proximal portion 266 of the boom section 240 and are controllable by the operator to move the boom section 240. A proximal portion 276 of the grapple 107 is coupled to the distal portion 268 of the boom section 240. The complete motion, or full extension and retraction, of the arch hydraulic cylinder(s) 260, and the boom hydraulic cylinder(s) 242 forms the envelope of movement 400 (described in detail below) for the grapple 207, wherein the grapple 207 collects a payload 140 such as logs.

The skidder 200 may further comprise a load measuring device(s) (280*a*, 280*b*, may be collectively referred herein to as 280) coupled to the boom assembly 110, wherein the load measuring device (280*a*, 280*b*) are configured to generate load signal(s) 288 indicative of a payload 140. Although the present disclosure indicates two locations for load measuring devices, the load measuring devices 280 comprises a first load measuring sensor 280*a* and a second load measuring sensor 280*b*. The first load measuring sensor 280*a* may comprise of one more sensors mounted at or near the grapple box to cross head rotary joint 158. The second load measuring sensor 280*b* may be mounted at the location where the boom section 240 is coupled to the arch section 230. The actual boom section lift and arch section pull load required are measured using load measuring sensor(s) 280*a* and load measuring sensor(s) 280*b*, respectively. The load signal(s) 288 are received by controller 205 creating an actual load measurement data log module 285 including real-time data wherein the database populates the schematic representations of the envelope of movement 400 with nodes 610 indicating loads at respective positions (shown in FIGS. 6A-6B) by extrapolating from a theoretical performance data module 293.

The work machine, or skidder 200 may further comprise a pin 215, wherein the pin 215 is located at a distal portion of the boom section 268. The pin 215 may comprise a point representing the coupling of the grapple 207 with the distal portion of the boom section 268, that may include the crosshead rotary joint 158. Alternatively, the pin 215 may comprise a central portion of the crosshead rotary joint. During calculations of load anywhere in the envelope of movement 400 by the controller 205, pin 215 represents the payload (i.e. the gravitational pull of load on the distal portion of the boom section 268). The controller 205 may use the measured/known load value and the known relative positions of the boom hydraulic cylinder(s) 242 and the arch hydraulic cylinder(s) 260 to extrapolate the relative load lift force required by boom hydraulic cylinder 242 and pull force required by the arch hydraulic cylinder 260 to move to the next position in the envelope of movement 400.

Figure 3:
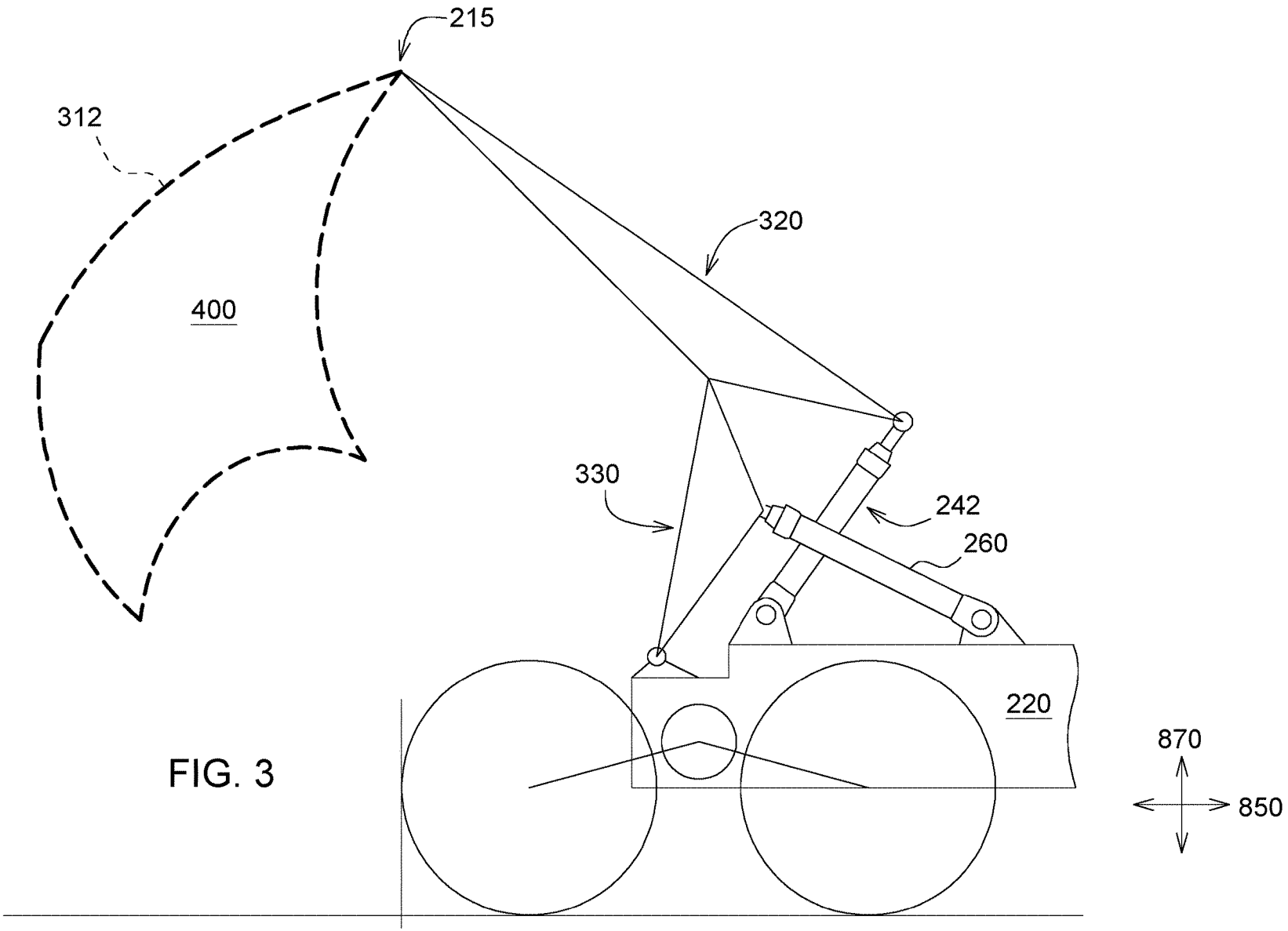
FIG. 3 illustrates a line schematic of the first exemplary embodiment shown in FIG. 1 wherein the envelope of movement is shown.

FIG. 3 illustrates a line schematic of the skidder 200 wherein the envelope of movement 400 is defined by a range of possible movement of the pin 215. The position of the pin 215 is defined by the lengths of the arch hydraulic cylinder(s) 260 and the boom hydraulic cylinder(s) 242. Movement of the arch hydraulic cylinders 260 and the boom hydraulic cylinder 242 combined define the position of the pin 215. The perimeter 312 of the envelope of movement 400 drawn by pin 215 is defined by one or more of the arch hydraulic cylinder(s) 260 and the boom hydraulic cylinder 242 being at a fully extended or retracted position. A perimeter of the arch hydraulic cylinder movement is shown by a first triangular configuration 330 as defined by the mechanical linkage of the boom assembly 110 (shown in FIG. 1). The first triangular configuration 330 is drawn by a point on the distal portion of arch hydraulic cylinder(s) 260 wherein the arch hydraulic cylinder(s) 260 are rotating between full extension and full retraction and the boom hydraulic cylinders 242 are rotating between full extension and full retraction. A perimeter of the boom hydraulic cylinder movement is shown by a second triangular configuration 320 as defined by the mechanical linkage of the boom assembly 110 with the boom hydraulic cylinder(s) 242 rotating between full extension and full retraction and the arch hydraulic cylinders 260 are rotating between full extension and full retraction.

Figure 4:
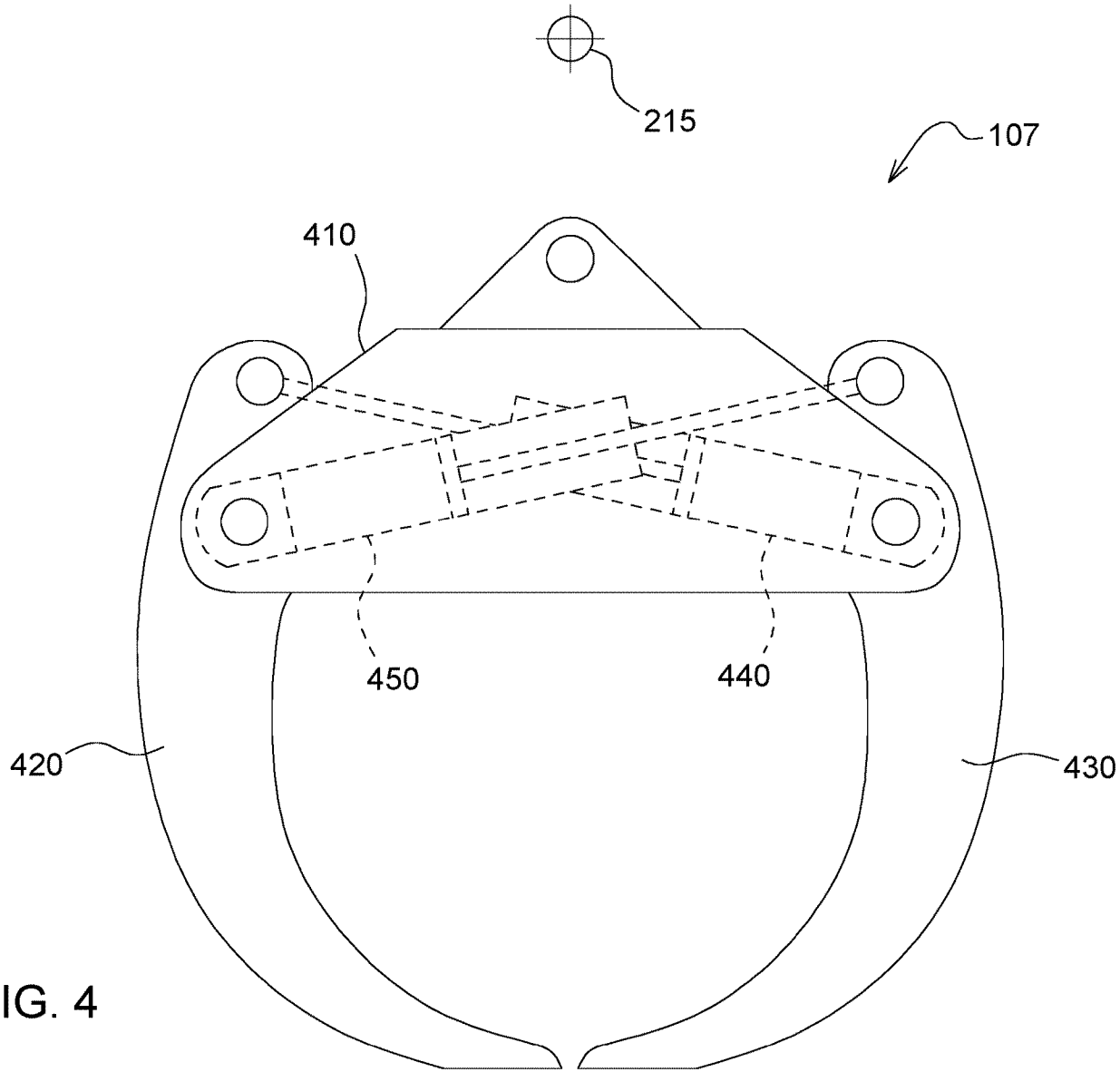
FIG. 4 illustrates a detailed view of a grapple of the first exemplary embodiment shown in FIG. 1.

Now turning to FIG. 4, a detailed exemplary embodiment of the grapple 107 is shown. The grapple 107 may include a base 410, left and right tongs 420, 430, and left and right hydraulic cylinders 440, 450. The base 410 is coupled to the distal portion of the boom section 268. The proximal ends of the left and rights tongs 420,430 are controllable by the left and right hydraulic cylinders 440,450 to open and close the grapple 207. The left hydraulic cylinder 440 has a head end coupled to the base 410, and a piston end coupled to the proximal end of the left tong 420. The right hydraulic cylinder 450 has a head end coupled to the base 410, and a piston end coupled to the proximal end of the right tong 430. The operator can control extension and retraction of the left and right hydraulic cylinders 440, 450 to open and close the grapple 107. When the left and right hydraulic cylinders 440, 450 are retracted, the proximal ends of the left and right tongs 420, 430 are brought closer together, which pulls apart the distal ends of the left and right tongs 420, 430 which opens the grapple 107. When the left and right hydraulic cylinders 440, 450 are extended, the proximal ends of the left and right tongs 420, 430 are pushed apart, which brings together the distal ends of the left and right tongs 420, 430 which closes the grapple 207. The operator can retract the left and right tongs 420, 430 to open the grapple 207 to surround a payload 140 (e.g. trees or other woody vegetation), and then extend the left and right tong cylinders 440, 450 to close the grapple 207 to grab, hold and lift the payload so the machine can move it to another desired location. The pin 215 may be located directly above the base 410 of the grapple 207 (designated by a cross 215 in FIG. 4).

Figure 5:
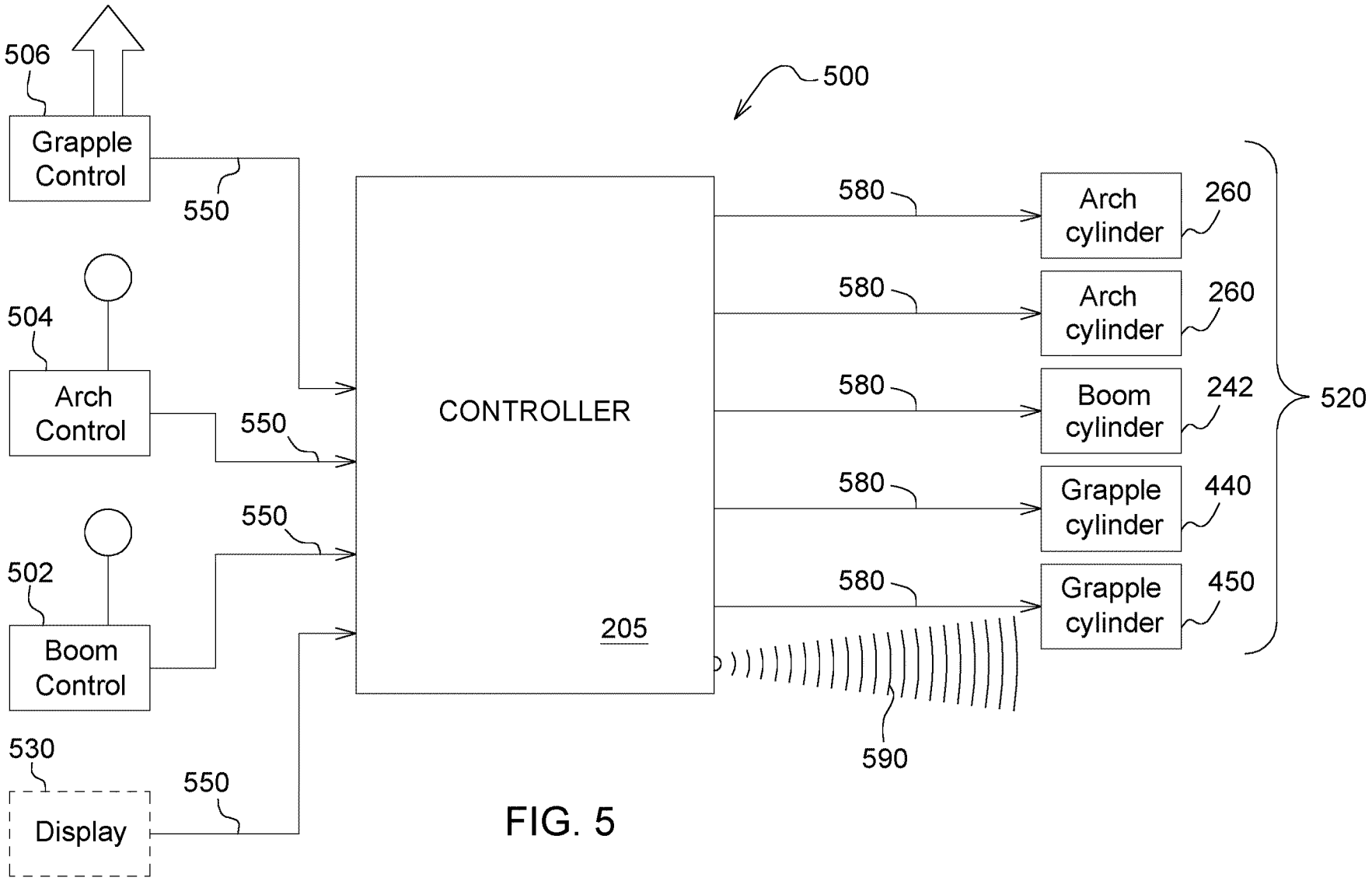
FIG. 5 illustrates some operator controls for the first exemplary embodiment shown in FIG. 1.

FIG. 5 illustrates a schematic example of the user input interface 500 from the operator's station for the arch hydraulic cylinders 260, boom hydraulic cylinders 242, and tong hydraulic cylinders (440, 450). In this first exemplary embodiment, the user input interface 500 may comprise discrete control members for boom control 502, arch control 504 and a grapple control 506. Discrete may be interpreted as an individual control member or movement of a control member in one direction yield movement of a first actuator 131 and movement of the control member in a different direction yields movement in a second actuator 136. The boom control 502 allows an operator to regulate extension and retraction of the boom hydraulic cylinders 242 to move the boom section 240 relative to the arch section 230. The arch control 504 controls extension and retraction of the arch hydraulic cylinder(s) 260 to lower and raise the arch section 230 relative to rear vehicle frame 220. The grapple control 506 controls extension and retraction of the tong hydraulic cylinders (440, 450) to open and close the grapple 207. The boom control 502, arch control 504, and grapple control 506 send user input signals 550 to the controller 205 and the controller sends command signals 580 to control the boom, arch, and tong hydraulic cylinders (260, 242, 440, 450) over control lines 520 (note commands may also be communicated wirelessly 590). The user input interface 500 may further comprise a performance display graphics module 530 (which may also simply be referred to a display) as described in further detail below.

Now returning to FIG. 2 with continued reference to FIG. 1, the controller 205 of the skidder 200 (work machine 100) is configured to receive a first position signal 236 (indicative of the position and angle of the arch section 230) from the first boom position sensor 132, a second position signal 238 (indicative of the position and angle of the boom section 240) from the second boom position sensor 138, and the load signal 288 (indicative of the payload) from the load measuring device 280. In this embodiment, the first boom position sensor 232 and the second boom position sensor 138 may comprise of one or more position sensors as exemplified in FIG. 2. Furthermore, the first boom position sensor 132 and the second boom position sensor position sensors 138 may further be coupled to their respective actuators (131, 136) wherein the position sensors allow for the controller 205 to determine the hydraulic capacities or alternatively load lift/pulling capability of each respective actuator (131, 131). The controller 205 comprises an actual load measurement data log module 285 to receive the load signal(s) 288 from the load measuring device(s) 280 and a position/angle data processor 290 to receive the first position signal(s) 236 and the second position signal(s) 238. Each type of signal (288, 236, 238) may be received in real-time creating a data log. The position/angle data processor 290 may use the known linkage geometry to calculate the respective position of pin 215 in the envelope of movement 400.

Figure 6B:
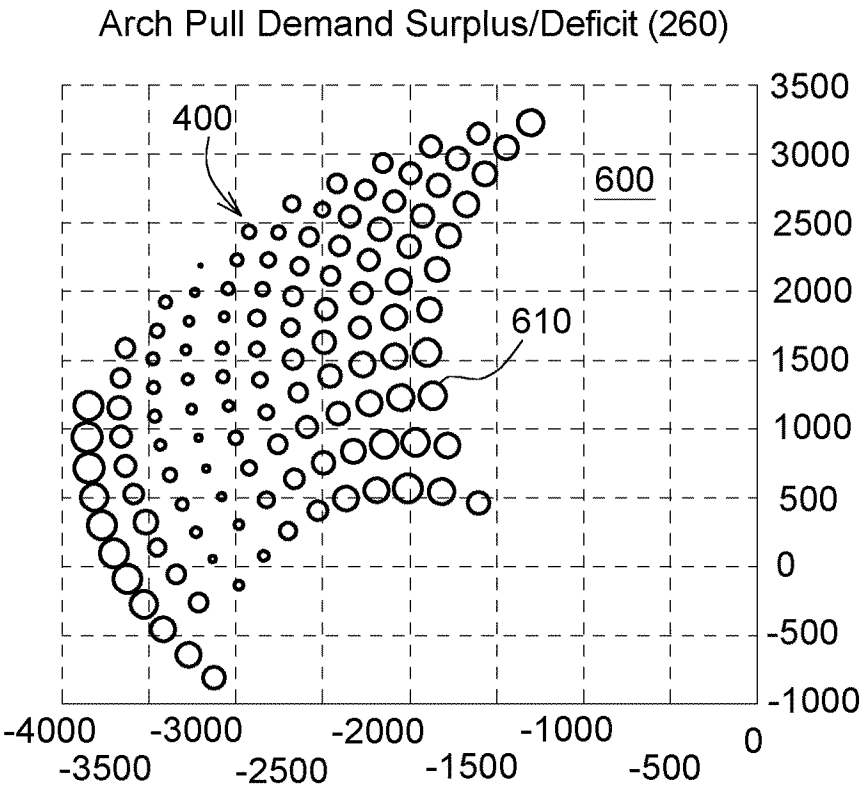
FIG. 6B is one embodiment of a map of hydraulic capacities within an envelope of movement for the arch hydraulic cylinder(s) of the embodiment shown in FIG. 1.
Figure 6A:
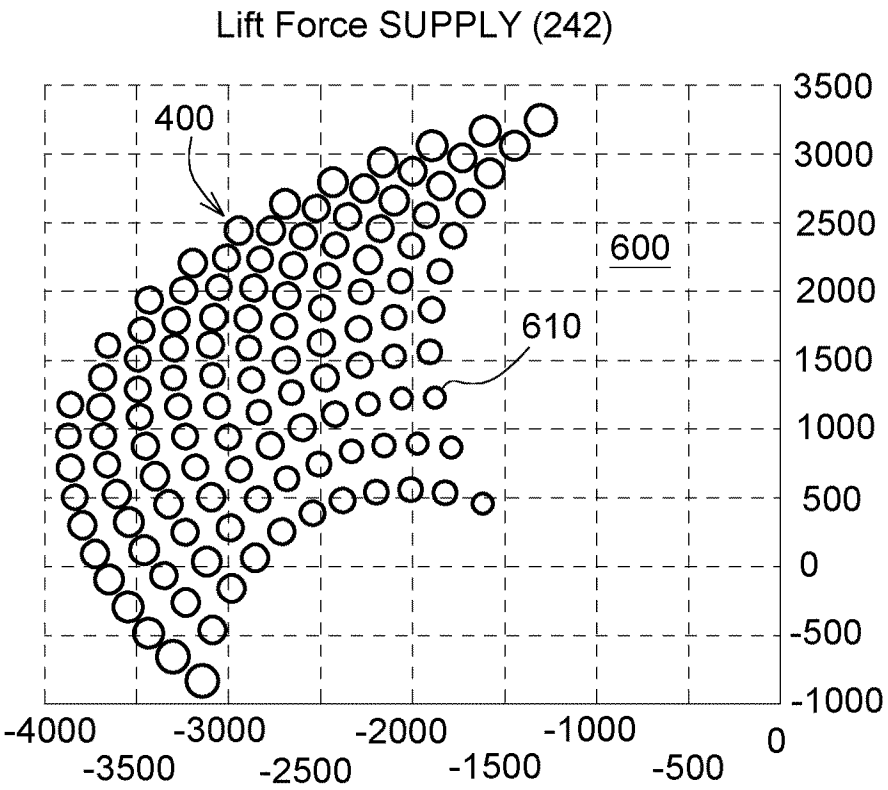
FIG. 6A is one embodiment of a map of hydraulic capacities within an envelope of movement for the boom hydraulic cylinder(s) of the embodiment shown in FIG. 1.

Now turning to FIGS. 6A, and 6B, the controller 205 is further configured to calculate a map of hydraulic capacities 600 within an envelope of movement 400 for one or more of the first and the second actuators (131, 136) based on the first position signal 236, the second position signal 238, and the load signal 288, and generate a lift path 710 for actuating each respective hydraulic cylinder within the envelope of movement 400 (shown in FIGS. 7A and 7B as dotted lines) of movement of the pin 215 through at least a portion of the envelope 400 based on the hydraulic capacities, wherein the available hydraulic capacity for lifting and pulling the payload 140 within the envelope of movement 400 is smaller than the envelope of movement without a payload 140. The map of hydraulic capacities 600 may be communicated to the operator on a performance display graphics module 530 on an operator device such as a screen in the operator cab, or a or an alternative device such as a tablet, mobile electronic, phone, a windshield screen overlay, and a remote operator station, to name a few. An alternative or supplemental option may be haptic feedback to the operator through the respective control member requiring movement for optimized control. Both usage of the performance display graphics module 530 and haptic feedback may advantageously provide guidance and a training opportunity for the operator. Because boom control member 502 and the arch control member 504 are distinct and separate in a grapple skidder 200, it becomes simple to implement haptic feedback.

The map of hydraulic capacities 600 comprises a series of nodes 610 (only one of several is indicated) representing the hydraulic capacities of one or more of the first and the second actuators (131, 136) throughout the envelope of movement 400 in real-time. FIG. 6A represents the hydraulic capacity of the boom hydraulic cylinder(s) 242 throughout the envelope of movement 400 through a series of nodes 610, or the boom lift capacity (i.e. the boom lift force capacity or deficit represented by a positive or negative number) throughout the envelope of movement 400 in real-time. The x-axis and the y-axis represent relative positions to frame 135 (i.e. based on the current position of the other respective actuators on the boom assembly 110). FIG. 6B represents the hydraulic capacity of the arch hydraulic cylinder(s) 260 (i.e. the arch pull capacity or deficit throughout the envelope of movement 400) in real-time (i.e. based on the current position of the other respective actuators on the boom assembly 110). Because movement of the boom hydraulic cylinder(s) 242 and the arch hydraulic cylinders 260 are controlled through individual control members (502 and 504 respectively) from the user input interface 500, commanding movement of the hydraulic cylinders (242, 260) may easily be interpreted from the map of hydraulic capacities 600 presented in FIGS. 6A and 6B. The capacity or deficit may be designated by a positive number or negative number indicated numerically at each node 610, and/or through a physical representation wherein the magnitude or size of each respective node 610 (e.g. a circle shown in this exemplary embodiment) indicates the magnitude of hydraulic capacity remaining based on the current actuator positions. For example, a small node may indicate little or no hydraulic capacity within the envelope of movement 400 at the respective location. Whereas, a large node may indicate ample capacity at the respective position. The current position of a pin 215 within the envelope of movement 400 may also be designated by a node of different color or symbol such that the operator may track its position in real-time. A series of nodes 610 located adjacent to one another with sufficient capacity in the envelope of movement 400 may indicate an optimal and/or safe pathway of movement (also referred to as lift path 710 in FIGS. 7A and 7B) of the pin 215. In an alternative embodiment, only nodes 610 with capacity may be designated by graphical representations at the nodes 610. In the embodiment shown in FIGS. 6A and 6B, the nodes 610 may fluctuate in values real-time as a hydraulic cylinder (242 or 260) moves through the envelope of movement 400. For example, if the operator manipulates movement of the boom hydraulic cylinders 242 to provide a lift force for payload 140 shown in FIG. 6A, the hydraulic capacities of the arch hydraulic cylinders 260 in FIG. 6B will re-populate each node 610 based on the new data (position). Although FIGS. 6A and 6B demonstrate an exemplary number of nodes 610 within the envelope of movement 400 for a grapple skidder 200, the number of nodes 610 may be modified based on the granularity of detail desired. On another note, the units along the x-axis and the y-axis may also be manipulated depending on payload 140 or country of operation. In the present embodiment, hydraulic capacity along the x-axis and y-axis is shown in kilonewtons.

Figure 7B:
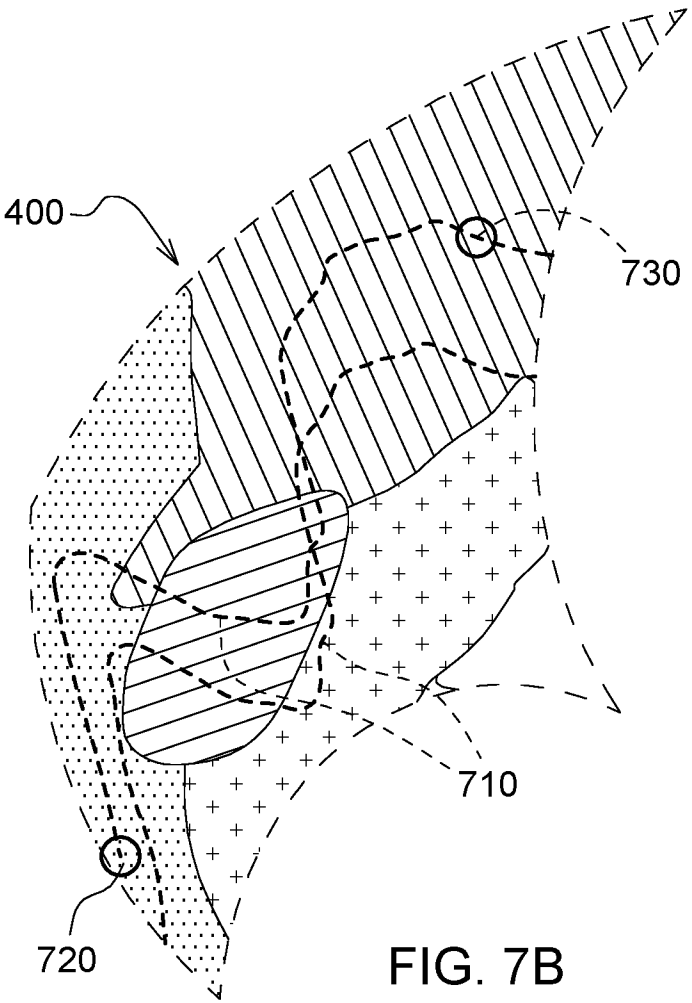
FIG. 7B one embodiment of a map of hydraulic capacities within an envelope of movement for the arch hydraulic cylinder(s) including a lift path of the embodiment shown in FIG. 1.
Figure 7A:
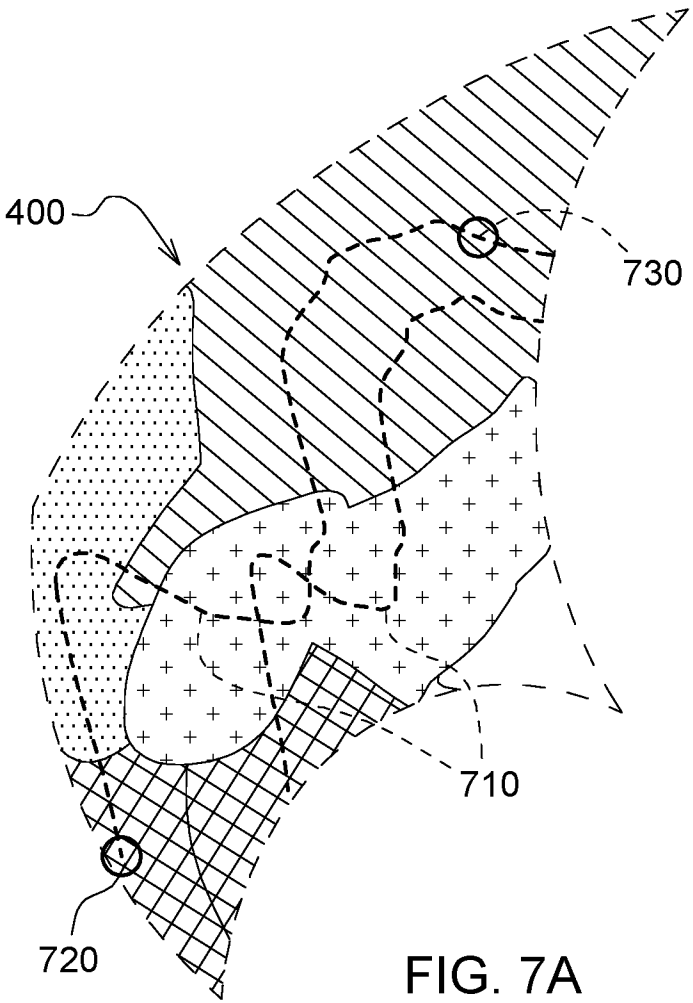
FIG. 7A is one embodiment of a map of hydraulic capacities within an envelope of movement for the boom hydraulic cylinder(s) including a lift path of the embodiment shown in FIG. 1.

Now turning to FIGS. 7A and 7B, the schematic shown comprises an envelope of movement 400 including a lift path 710 (designated by the dotted line) of the pin 215 from a first position 720 to a second position 730 through nodes 610 with sufficient hydraulic capacity to carry respective payload 140 that may be measured by the load measuring device 280. Note that more than one lift path 710 may be shown simultaneously as exemplified in the embodiment shown.

The envelope of movement 400 shown in FIGS. 7A and 7B may be further enhanced when on display on a graphical user input interface wherein portions of the envelopment of movement 400 are color-coded, or pattern-coded. The color-code is based on the degree of hydraulic capacity for the respective hydraulic cylinder the envelope of movement 400 is associated with, when the pin 215 is positioned at the location designated within the envelope of movement 400. In one embodiment of the envelope of movement 400, the color green may indicate a hydraulic capacity beyond 20%, the color red may indicate a deficit of hydraulic capacity; the color yellow may indicate a capacity between 0% and 5%; and the color purple may indicate a capacity between 5% and 20%, for moving payload 140. Note, hydraulic capacity may also correlate to the amount of travel a pistol portion may have remaining in the cylinder of a hydraulic cylinder. The lift path 710 indicates an optimized trajectory for movement of the pin 215 from a first position 720 to a second position 730 through a series of nodes 610 with sufficient hydraulic capacity for the respective actuator 120. In the embodiment of a grapple skidder 200, the first position 720 indicates the current position of pin 215, and the second position 730 may indicate the desired final position, for example a transport position wherein a payload 140 is sufficiently lifted above ground in preparation for transport. The user input interface 500 may allow the operator to toggle between the map of hydraulic capacities with nodes 610, and the map of hydraulic capacities with a suggested lift path 710 (with or without color-coding).

Returning to FIGS. 1 and 2, and also now referring to FIGS. 8 and 9, the controller 205 of the work machine 100 may further receive an inclination signal 295 from an inclination sensor 160 coupled to the work machine 100 when calculating the map of hydraulic capacities 600 (shown in FIG. 6). FIG. 8 depicts a line schematic of the work machine 100, a grapple skidder 200, on an inclined surface 810. The inclination sensor 160 may determine the inclination of the horizontal-longitudinal axis 850 of the work machine 100 relative to the ground (shown as a) and the controller 205 may modify the load signal(s) 288 based on this inclination signal 295. In other words, the inclination is the vector 820 representing the payload 140 from a point located at or near pin 215 relative to frame 130 when accounting for directional change in gravitational pull because of the incline angle α. That is, in a steep slope condition, the controller 205 will populate the envelope of movement 400 with hydraulic capacities while taking into consideration the directional pull of the payload as it affected by gravity, with respect to the directional pull on the actuators 120 as seen in FIG. 8. Vector 805 represents a first directional pull of load 140 if work machine were located on a flat ground surface. Vector 820 represents a second directional pull of payload 140 with work machine located on the inclined surface 810. The incline angle α is equivalent to the change in the relative angle of the payload 140.

FIG. 9 depicts a detailed schematic of the intelligent mechanical linkage performance system 300 as it relates to the first exemplary embodiment shown in FIG. 1. More specifically, the intelligent mechanical linkage performance system 300 as applied to the grapple skidder 200 is illustrated. In one non-limiting example, the intelligent mechanical linkage performance system 300 comprises a first boom position sensor 132 coupled with the first section of the boom assembly 110 of the work machine 100 for generating a first position signal 236 indicative of a position of the first actuator 131. The intelligent mechanical linkage performance system 300 comprises of a second boom position sensor 138 coupled with a second section of the boom assembly 114 of the work machine 100 for generating a second position signal 238 indicative of a position of the second actuator 136. The first position signal 236 and the second position signal 238 are received by a position/angle data processor 290 which may be located on the controller 205 to determine the relative positions and/or angles of the first section of the boom assembly 110, the second section of the boom assembly 114, and ultimately the pin 215 to frame 130.

A load measuring device 280 is coupled to the boom assembly 110 wherein the load measuring device 280 is configured to generate a load signal 288 indicative of the payload 140, wherein the load signal 288 is received by the controller 205. The intelligent mechanical linkage performance system 300 further comprises the pin 215 (mentioned above) coupled to the second section of the boom assembly 114 at a location distal form the first section of the boom assembly 110, wherein movement of the pin 215 creates an envelope of movement 400 throughout which the pin 215 is moveable by the first section 112 and the second section 114. An implement 105 may be coupled to the pin wherein the implement is configured to engage the payload. As previously mentioned the perimeter 312 of the envelope of movement 400 is determined by one or more hydraulic cylinders 125 coupled to the boom assembly 110 being at a fully extended or retracted position. That is the perimeter 312 is determined by the full range of possible movement with each actuator 120 extended or retracted given the linkage geometry of the work machine 100. The intelligent mechanical linkage performance system 300 further comprises a controller 205 coupled to the work machine 100 wherein the controller is configured to receive a first position signal 238 from the first boom position sensor 138; receive a second position signal 238 from the second arch position sensor 136; and receive the load signal 288. The controller 205 comprises an actual load measurement data log module 285, a theoretical performance data module 293, and a performance display graphics module 530. The position/angle data processor 290 receives the position signals (236, 238) in real-time from the first boom position sensor 132 and the second arch position sensor 138, and the load signals 288 in real-time. The controller 205 upon receiving this information, identifies the node 610 in the envelope of movement 400 wherein the pin 215 is located. The controller 205 then analyzes and optimizes the first section 112 (arch pull of grapple skidder) and the second section 114 (boom lift of grapple skidder) force requirements throughout the geometry of the envelope of movement 400 based on the load signals 288 and the first and second position signals (236, 238), by correlating the identified node 660 (i.e. node representing current position) within the envelope of movement 400 to the theoretical data performance module 293. The theoretical performance data module 293 may comprise of theoretical load capacities throughout the envelope of movement 400 and is a prepopulated with hydraulic capacities of each respective hydraulic actuator for each respective node within the envelope of movement 400 given a pre-identified payload (e.g. the payload could be zero or some other minimum load). Once the node 610 is identified, the controller 205 then extrapolates from the theoretical performance data module 293 knowing the ratio between the identified node 660 and corresponding node in the theoretical performance data module 293, and populates the remaining envelope of movement 400, calculating a map of hydraulic capacities for either or both the first actuator and the second actuator based on the payload 140. Note that the load signal 288 may fluctuate at any given time because a portion of the payload 140 may drag on the ground because a grapple skidder 200 generally moves tall felled trees. As seen in FIGS. 6A and 6B, the map of hydraulic capacities throughout the envelope of movement comprises a series of nodes demonstrating the available load supply from the hydraulic system of the work machine for each respective actuator. This can be designated by a positive number (shown as +) as in an available supply, or a negative number (shown as −) as in a deficit of force (i.e. insufficient force to pull the payload 140 from the current position (note the current position may also be the identified node 660) to a second position, wherein the second position is generally identified as the transport position).

Additionally, the operator may toggle the intelligent mechanical linkage performance system 300 between automatic mode 375 and semi-automatic mode 365. In automode, the controller 205 may be configured to inhibit movement of the pin 215 to a plurality of nodes 610 within the envelope of movement 400 where there is insufficient hydraulic capacity for moving payload 140. Furthermore, in automatic mode 375, the controller may automatically move the boom assembly following the calculated lift path 710 as designated by the dotted lines seen in FIGS. 7A and 7B (for example), as the operator follows movement on the performance display graphics module 530. The lift path 710 can change in real-time as pin 215 moves. This may be because of how the payload engages 140 the ground surface or the inclined surface 810 of the ground surface, to name a few. Alternatively, in semi-automatic mode 365 the display shows the real-time envelope of movement 400, visually-coded (color or patterns) to communicate to the operator the available load supply from the hydraulic system based on the payload 140 for each node 610 throughout the envelope of movement 400. The operator may then use the user input interface 500 to maneuver pin 215 and ultimately the payload 140 to a transport position using the suggested lift path 710 as a guide. Furthermore, in semi-automatic mode 365 the controller may further provide haptic feedback to the operator as a guide (e.g. a vibration of the control member requiring movement).

FIG. 10 is a side view of a second exemplary embodiment of a work machine 100 having an intelligent mechanical linkage performance system 300. The work machine 100 is embodied as an excavator 900 including an upper frame 910 pivotally mounted to an undercarriage 915. The upper frame 910 can be pivotally mounted on the undercarriage 915 by means of a swing pivot. The undercarriage 915 can include a pair of ground engaging tracks 920 on opposite sides of the undercarriages 915 for moving along the ground surface. The upper frame 910 includes an operator cab in which the operator controls the excavator 900. The operator may actuate one or more controls of the controller 205 for purposes of operating the excavator 900. These controls may include a steering wheel, control levers, controls pedals, control buttons, and a graphical user input interface with display. The excavator 900 includes a boom assembly 110 comprising a large boom 925 (first section of the boom assembly 112) that extends from the upper frame 910 (frame 130) adjacent to the operator cab 226 and a dipper stick 935 (second section of the boom assembly 114). The large boom 925 is rotatable about a vertical arc relative the upper frame 910 by actuating large boom hydraulic cylinder(s) 930 (first actuator). The dipper stick 935 is coupled to the large boom 925 and is pivotable relative to the large boom 925 by means of a dipper stick hydraulic cylinder 940 (second actuator). Coupled to the end of the dipper stick 935 is an implement 105 (shown as a bucket 905) wherein the implement 105 is pivotable relative to the dipper stick 935 by an implement hydraulic cylinder 945.

Figure 11:
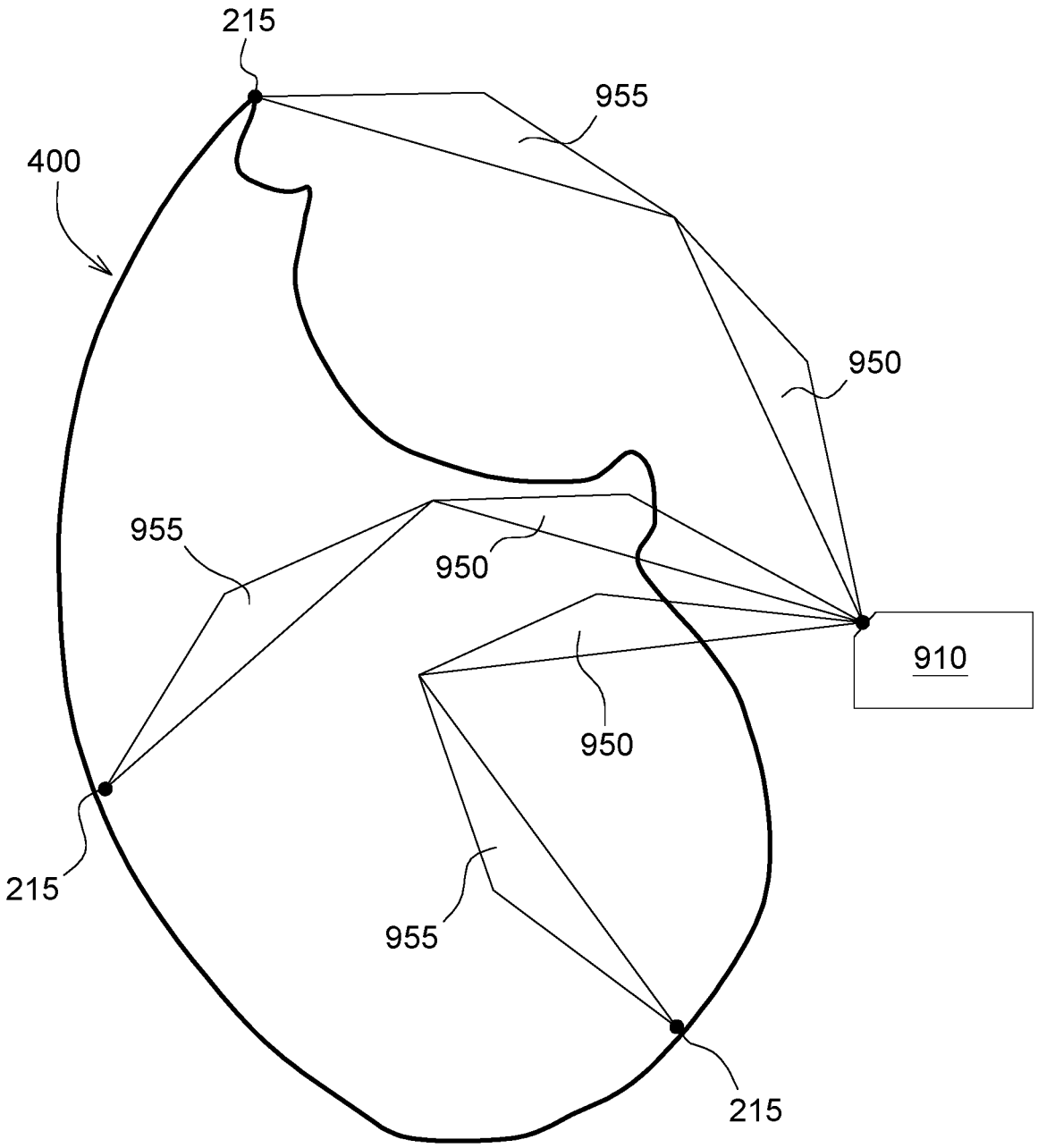
FIG. 11 is a line schematic of the second exemplary embodiment shown in FIG. 10 wherein the envelope of movement is shown.

FIG. 11 is a line schematic of the second exemplary embodiment shown in FIG. 10 wherein the envelope of movement 400 for an excavator 900 is shown. The envelope of movement 400 is defined by a range of possible movement of pin 215. The position of pin 215 is defined by the lengths of the large boom hydraulic cylinders and the dipper stick hydraulic cylinder(s) 940. The perimeter (as designated by the solid black line) of the envelope of movement 400 drawn by pin 215 is defined by one or more of the large boom hydraulic cylinder(s) 930 and the dipper stick hydraulic cylinder(s) 940 being at a fully extended or retracted position. A perimeter of the large boom hydraulic cylinder movement is shown by a series of first geometric configurations 950 as defined by the mechanical linkage of the boom assembly 110 (shown in FIG. 10). The first geometric configuration 950 is drawn by a point on the distal portion of the large boom hydraulic cylinder(s) 930 wherein the large boom hydraulic cylinder(s) 930 are rotating between full extension and full retraction and the dipper stick hydraulic cylinder(s) 940 are rotating between full extension and full retraction. A perimeter of the dipper stick hydraulic cylinder movement is shown by a series of second triangular configurations 955 as defined by the mechanical linkage of the boom assembly 110 with the large boom hydraulic cylinder(s) 930 rotating between full extension and full retraction and the dipper stick hydraulic cylinders 940 are rotating between full extension and full retraction.

Figure 12:
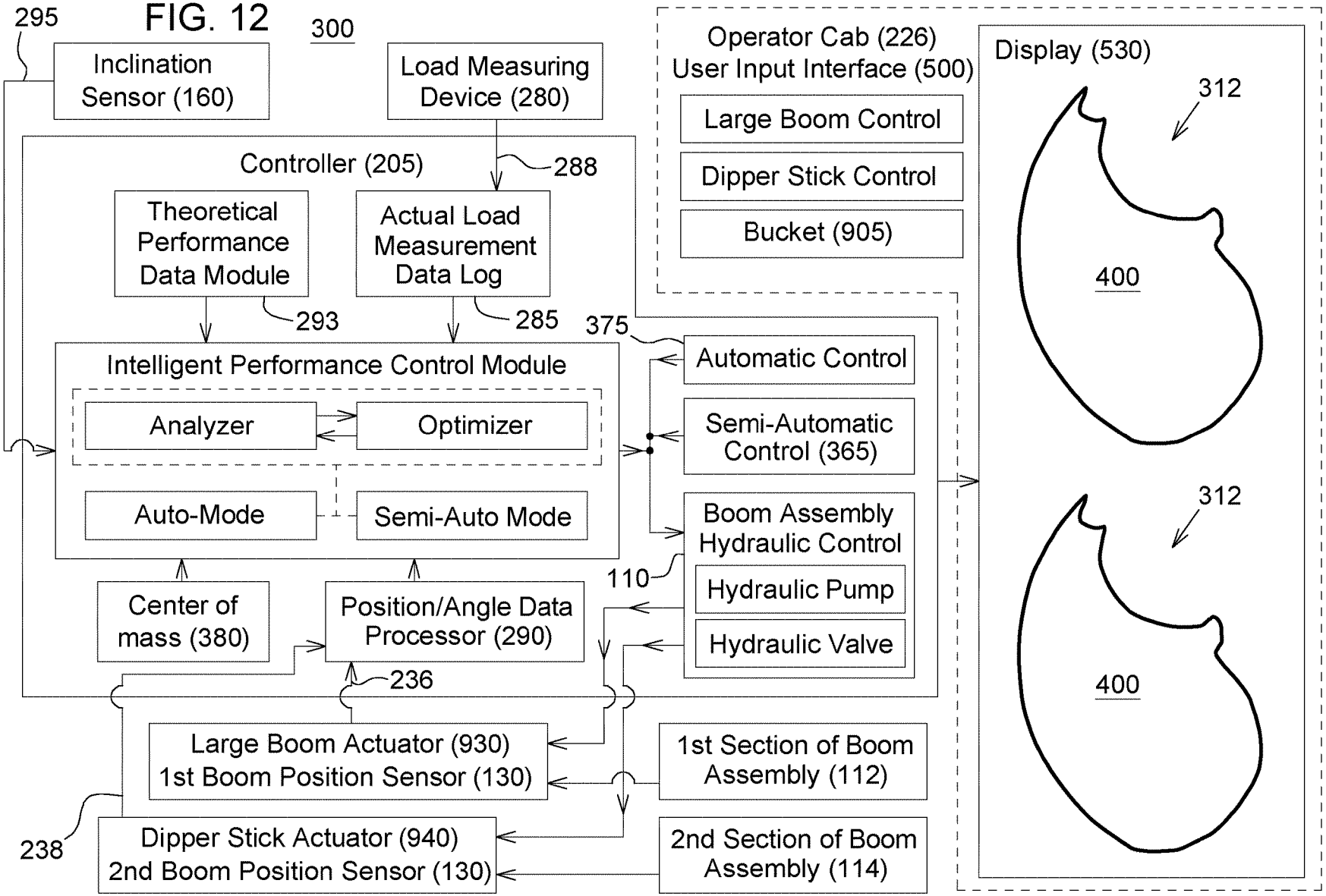
FIG. 12 is a detailed schematic of the intelligent mechanical linkage performance system as it relates to the second exemplary embodiment in FIG. 10.

FIG. 12 is a detailed schematic of the intelligent mechanical linkage performance system 300 as it relates to the second exemplary embodiment, an excavator 900, as shown in FIG. 10. The system is similar to the intelligent mechanical linkage performance system 300 shown in FIG. 9 with the exception of the descriptive inputs of the user input interface 500 (i.e. large boom 925 control, dipper stick 935 control, and bucket 905 control), and outputs on a performance display graphics module 530 (i.e. the envelope of movement 400 and relevant data calculated reflects the configuration of the excavator 900 as discussed in FIG. 11). Because the actuator 120 lengths and linkage geometry are different, the envelope of movement 400 will be different. However, the system and method optimizing the performance may be the same. Additionally, the controller may be further configured to identify a payload center of mass 380. The payload center of mass 380 may be based on a third position signal received from a third actuator 945 wherein the implement 105 is moveable by the third actuator 945. The controller 205 modifies the load signal 288 based on the payload center of mass 380.

Figure 13:
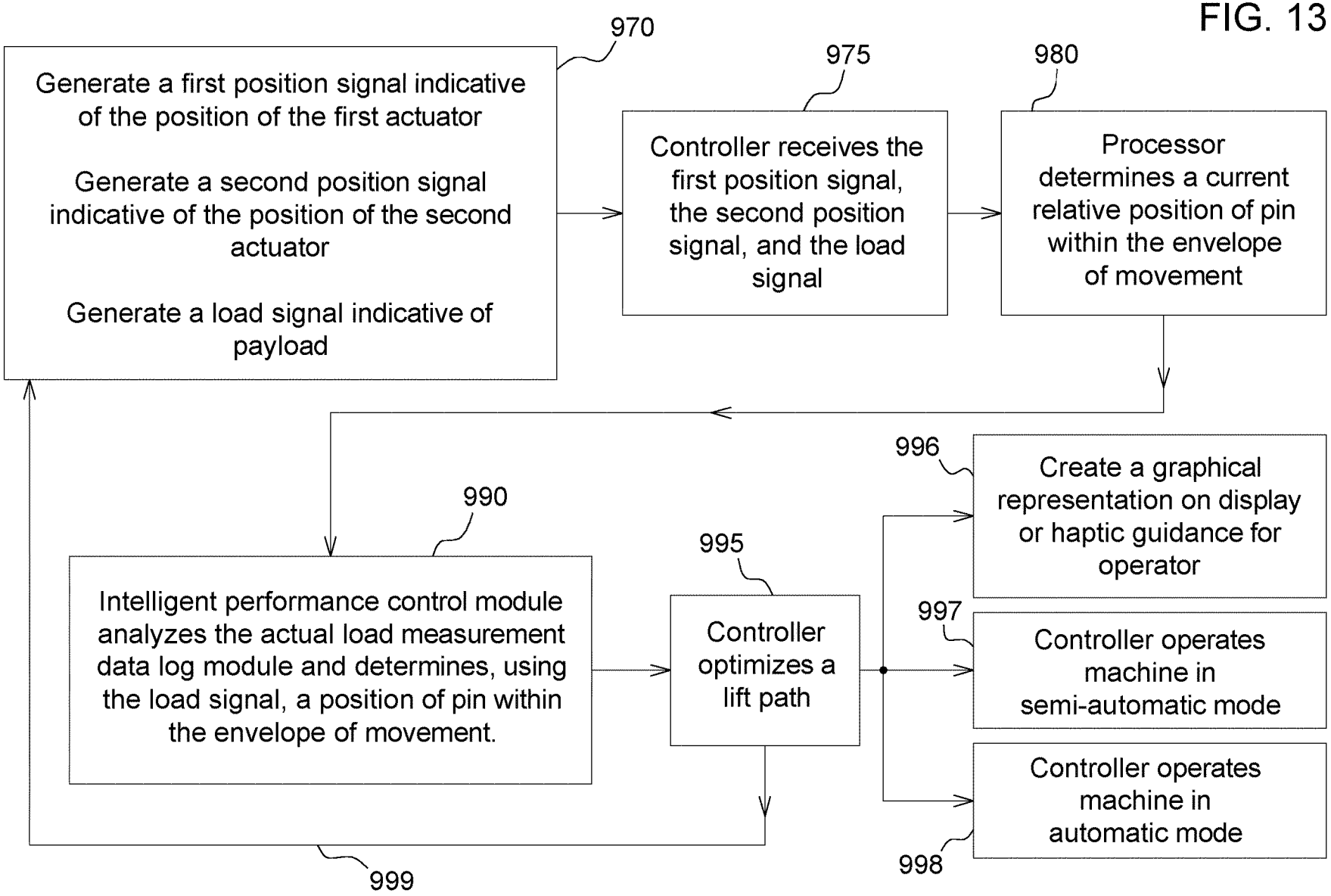
FIG. 13 is a method related to the intelligent mechanical linkage performance system.

FIG. 13 is a method of a control system for a boom assembly 110 of a work machine 100 to intelligently control the boom assembly during a payload 140 moving operation. In a first block 970, a first actuator sensing system 132 coupled with a first section of the boom assembly 112 of the work machine 100 generates a first position signal 236 indicative of the position of the first actuator 131; a second actuator sensing system 138 coupled with the second section of the boom assembly 114 generates a second position signal 238 indicative of the position of the second actuator 136; and a load measuring device 280 generates a load signal 288 indicative of payload 140. In a second block 975, the controller 205 receives these signals (i.e. the first position signal 236, the second position signal 238, load signal 288). In a third block 980, the receipt of the first and second position signals (236, 238) by the position/angle data processor 290 allows the processor to determine current the relative position of pin 215 within the envelope of movement. In a fourth block 990, the intelligent performance control module on the controller 205, analyzes the actual load measurement data log module 285 and utilizes the load signal 288 and determined position of pin 215 within the envelope of movement 400 to populate the remaining envelope of movement by extrapolating from load values in the theoretical performance data module 293. In a fifth block 995, the controller 205 then optimizes lift path 710 (i.e. movement of pin 215 from the current position to a transport position) through a series of positions represented by nodes 610 within the envelope of movement. From a sixth block 996, the controller 205 has the option to create a graphical representation communicated on performance display graphics module 530 or haptic guidance for the operator designating a series of discrete movements for each respective actuator 120 to move to a next position (i.e. generally towards the transport position). At the same time, in block 997, the controller 205 may operate the machine in semi-automatic 365 mode wherein movement to specific nodes 610 within the envelope of movement 400 may be restricted. The operator may have to navigate utilizing the allowed regions within the envelope of movement only. Alternatively, in block 998, the controller 205 may operate in automatic mode 375 wherein the pin 215 moves from a first position 720 to the intended second position 730 (e.g. the transport position) automatically with minimal or no assistance from the operator. Block 995 is continuously updated through loop 999 as the pin 215 moves through the envelope of movement 400. The intelligent mechanical linkage performance system 300 thereby advantageously allows for the machine to update and re-strategize its approach real-time.

Figure 14:
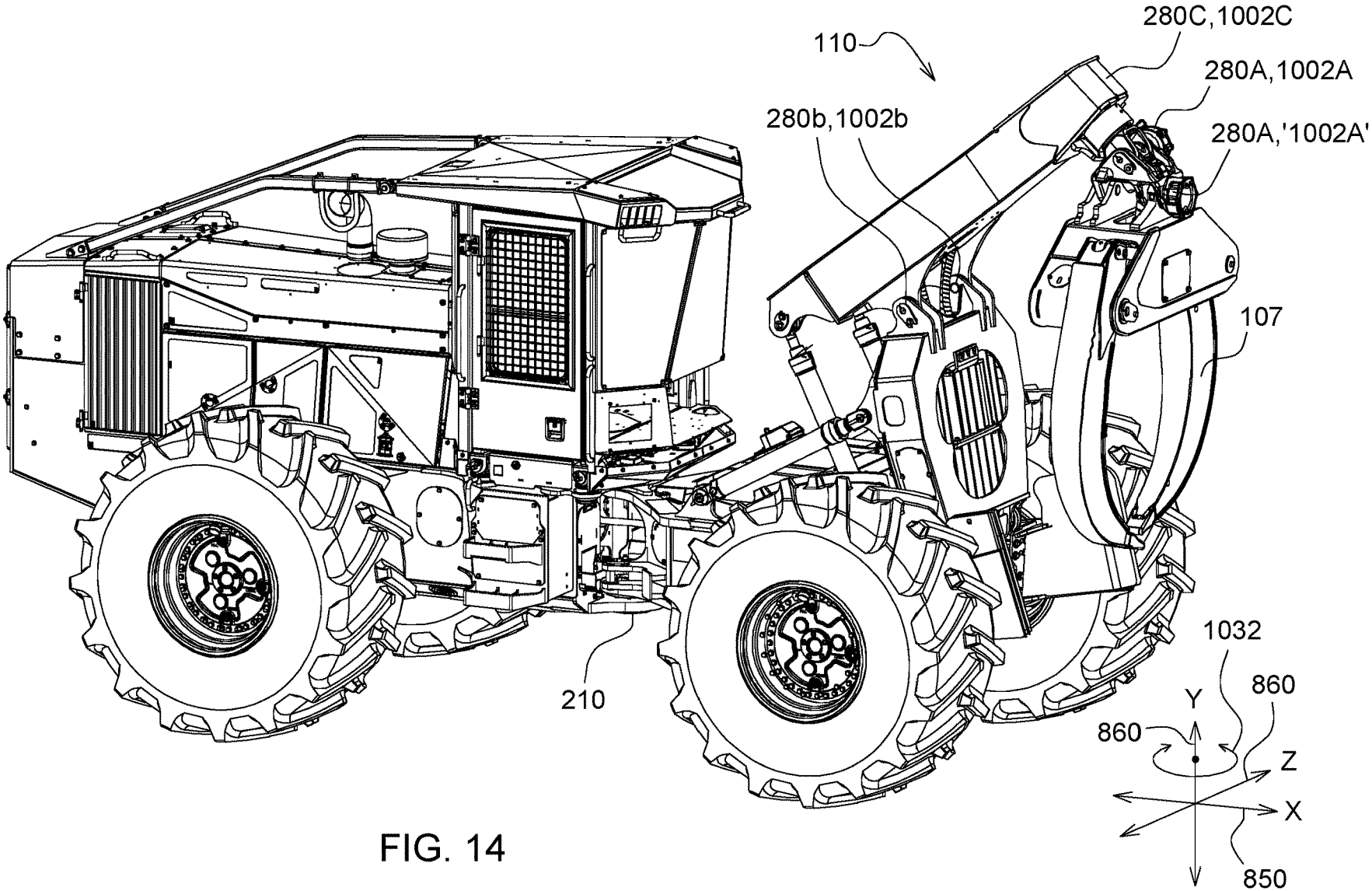
FIG. 14 is a perspective view a skidder.
Figure 15:
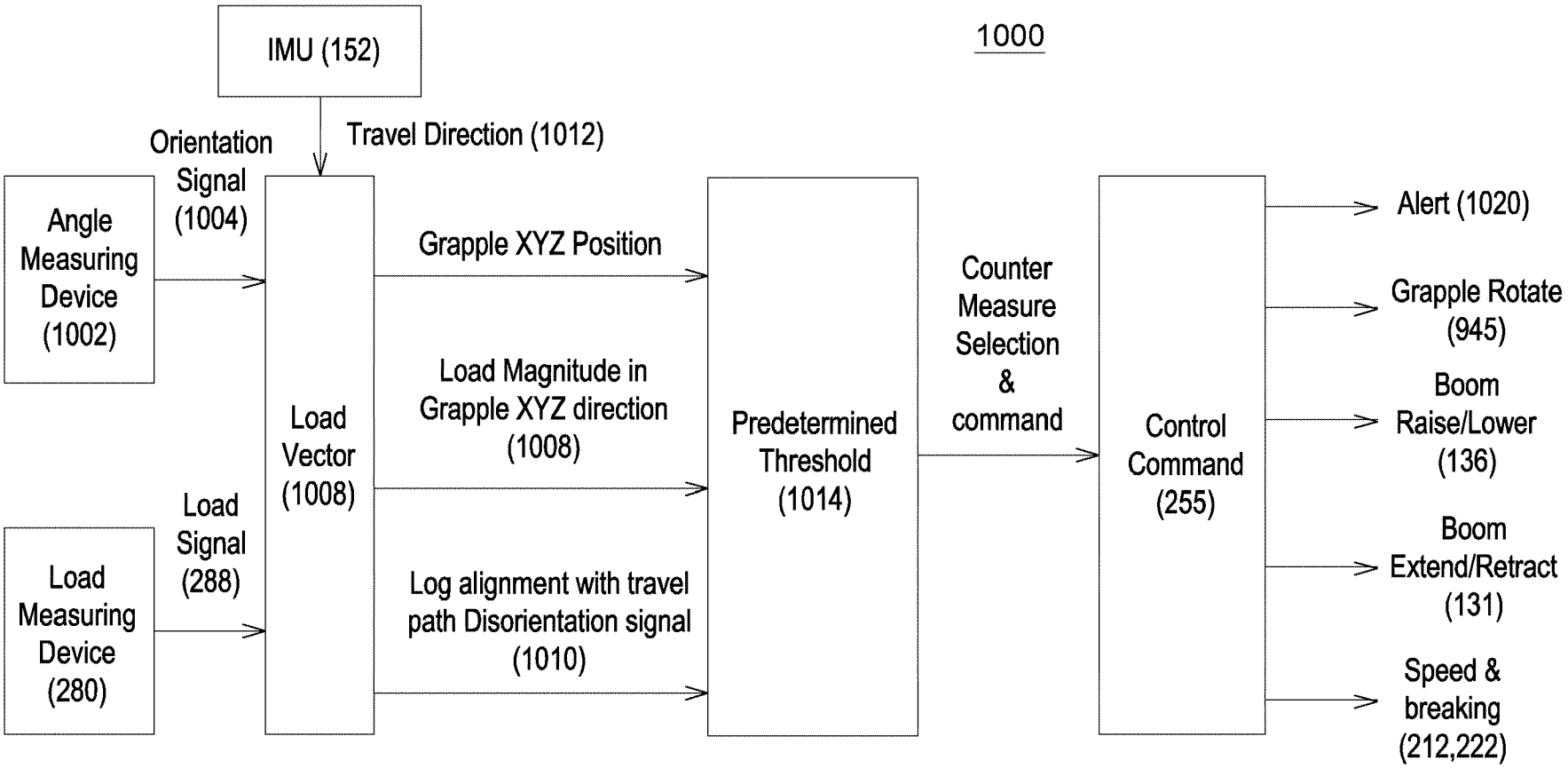
FIG. 15 is a diagram of the dynamic assist system.

Now referring to FIGS. 14 and 15, an alternative approach of an intelligent assist system 1000 on a work machine 100 (or more specifically a skidder) carrying a payload 140, such as felled trees is disclosed. FIG. 14 shows a perspective view of a work machine 100. The work machine includes a frame 130, a boom assembly 110 including a grapple 107 coupled thereto, a load measuring device (280*a*, 280*b*, or 280*c*) coupled to the boom assembly 110, an angle measuring device (1002*a*, 1002*b*, 1002*c*) coupled to the boom assembly 110, and a controller 255. An IMU 152 may be coupled to the work machine to sense a travel direction 1012.

By way of reference, the x-axis 850 runs in a fore-aft direction of the work machine 100. Movement of the boom assembly 110 in the x direction enables pulling the payload 140 towards the frame of the work machine 100. The y-axis 870 extends perpendicular to the x-axis 850 in a vertical direction. Movement of the boom assembly in the y directions enables lifting of the payload 140 from the ground for transport. The z-axis 860 run perpendicular to both the x-axis and the y-axis. Movement of the grapple in the z-direction counters loads acting sideways on the work while making turns, driving on slopes, or from when logs are drifting on either side during suspension, for example. The intelligent assist system 1000 accounts for the work machine response mechanism for load vectors in this three-dimensional space. The rotational force 1032 about the grapple 107 occurs in the x-z plane.

Aside from the load measuring devices (280*a*, 280*b*) previously described, in the exemplary embodiment of FIG. 14, the intelligent system 1000 may use two dual channel XY type load pins as slumber pins 280*a* and 280*a*' alongside angle measuring devices 1002*a* and 1002*a*'. The load measuring sensor 280*a* may comprise of one more sensors mounted at or near the grapple box to cross head rotary joint 158 (also referred to as a crosshead assembly). The second load measuring sensor 280*b* may be mounted at the location where the boom section 240 is coupled to the arch section 230. The actual boom section lift and arch section pull load are measured using load measuring sensor(s) 280*a* and load measuring sensor(s) 280*b*, respectively. The load signal(s) 288 are received by controller 205 creating an actual load measurement data log module 285 including real-time data wherein the database populates the schematic representations of the envelope of movement 400 with nodes 610 indicating loads at respective positions by extrapolating from a theoretical performance data module 293.

The angle measuring devices 1002 are configured to generate an orientation signal 1004 indicative of an orientation of the payload 140 relative to the frame 130.

The controller 255 comprises a memory that stores computer-executable instructions and a processor that executes instructions to monitor a first position signal 230 from the first boom position sensor 138, a second position signal 238 from the second boom position sensor 138, a load signal 288 from the load measuring device 280, and an orientation signal 1004 from the angle measuring device 1002. The controller 255 may then calculate a load vector 1008, at or near pin 215, based on the load signal 288 and the orientation signal 1004, generate a disorientation signal 1010 based on the load signal 288 and a direction of travel 1012. It may then determine if the disorientation signal 1010 is outside a predetermined threshold 1014. In response to the disorientation signal 1010 exceeding a predetermined threshold 1014, the controller 255 may actuate one or more of the first actuator 131 (coupled to the boom), the second actuator 136 (coupled to the arch), the third actuator 945 (coupled to the grapple), and the ground-engaging mechanism (212, 222). Doing so may reduce torsional forces on the boom assembly 110. Additionally, if the disorientation signal 1010 exceeds the predetermined threshold 1014, the controller 255 may reorient either the payload 140 and the work machine 100 relative to the payload. The controller 255 may further adjust the ground-engaging mechanism (212, 222) with travel speed, braking, gears, and travel direction, for example.

An alert 1020 may be generated if a disorientation signal 1010 of a load vector 1008 exceeds a first predetermined threshold. Predetermine thresholds may be defined by one or more of magnitude and direction of the load vector 1008. This alert 1020 may incrementally change in correlation with the magnitude of the load vector 1008. That is, a first alert may be generated when the disorientation signal 1010 reaches a first predetermined threshold, a second alert may be generated when reaches a second predetermined threshold.

In an exemplary embodiment (not shown) of a semi-automatic work machine, a communication portal for communicatively coupling the controller to a remote controller may be used as a tool for the operator. The operator may remotely view the disorientation signal 1010 and current positioning of the actuators, and manipulate the actuators, ground-engaging mechanism, and direction of travel to realign the payload within the predetermined threshold. The system 1000 advantageously improves precision control by monitoring the log load movement and proactively taking corrective action to reduce stresses on the work machine, thereby improving efficiency and productivity by optimizing the relative position of the payload to the work machine to reduce skidding resistance. Monitoring orientation angles and load vectors may create a database tracking activity of the work machine. This may advantageously serve as a visual indicator of loads outside a normal spectrum of use.

Figure 18:
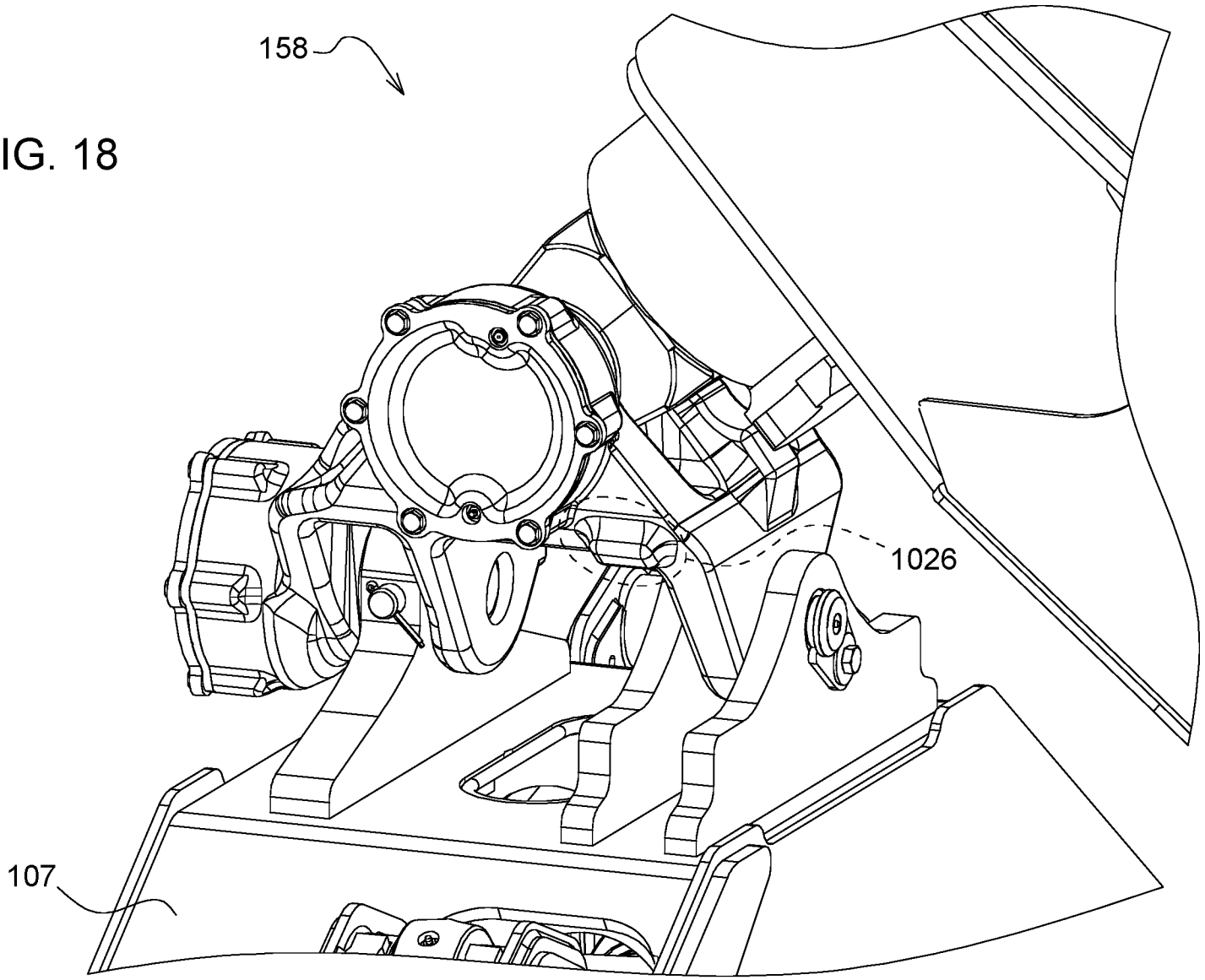
FIG. 18 is an exemplary embodiment of the crosshead assembly with a boom stopper.

Furthermore, as shown in FIG. 18, the grapple suspension coupling may comprise of a crosshead assembly 158 with boom stoppers 1026. The boom stoppers 1026 may limit the free-range motion of the suspended grapple 107. More specifically the boom stoppers 1026 may limit the swing of the grapple 107 up to 30 degrees, for example.

Figure 16:
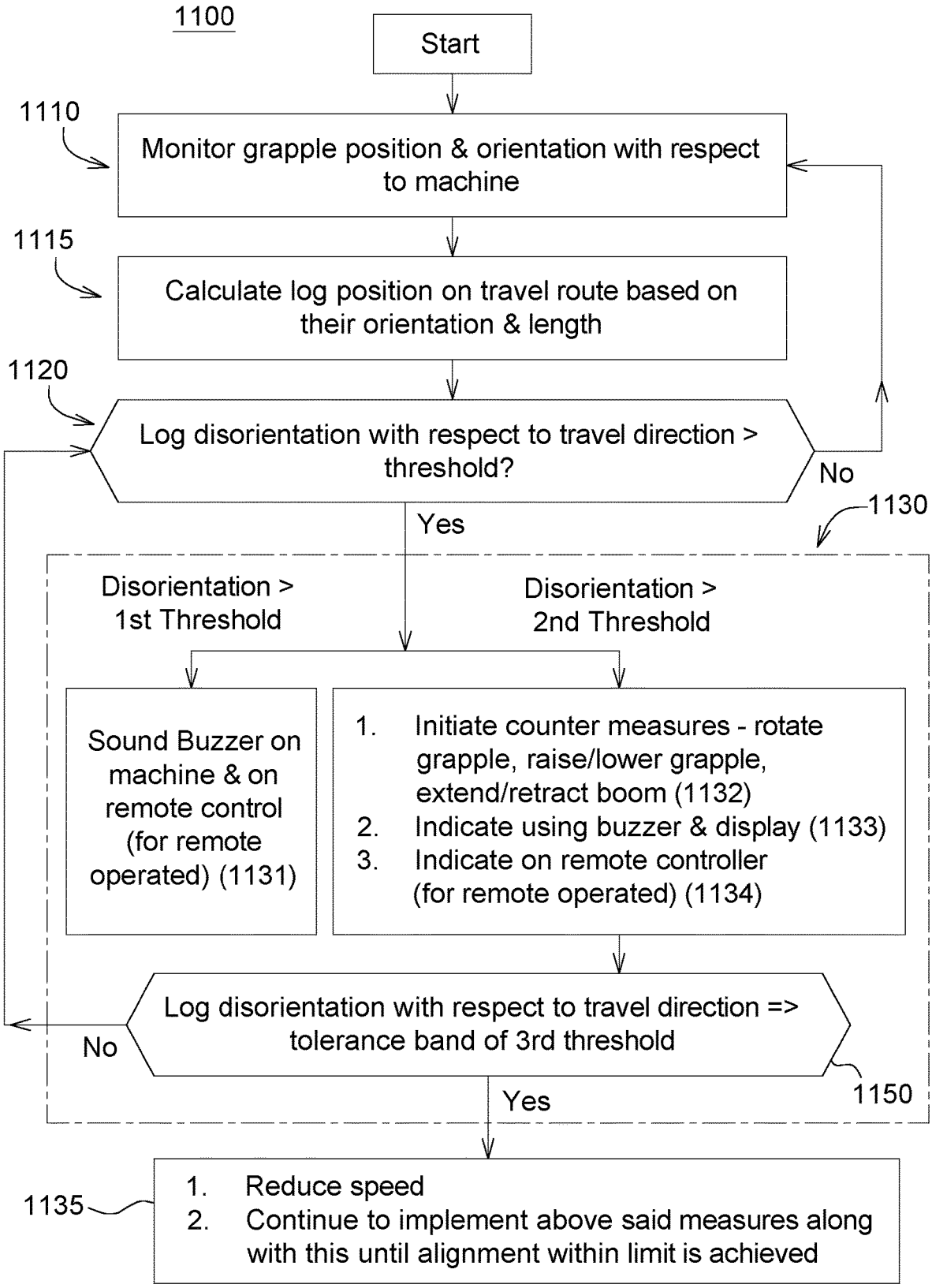
FIG. 16 is a generic flowchart of the dynamic assist system according to a first embodiment.
Figure 17:
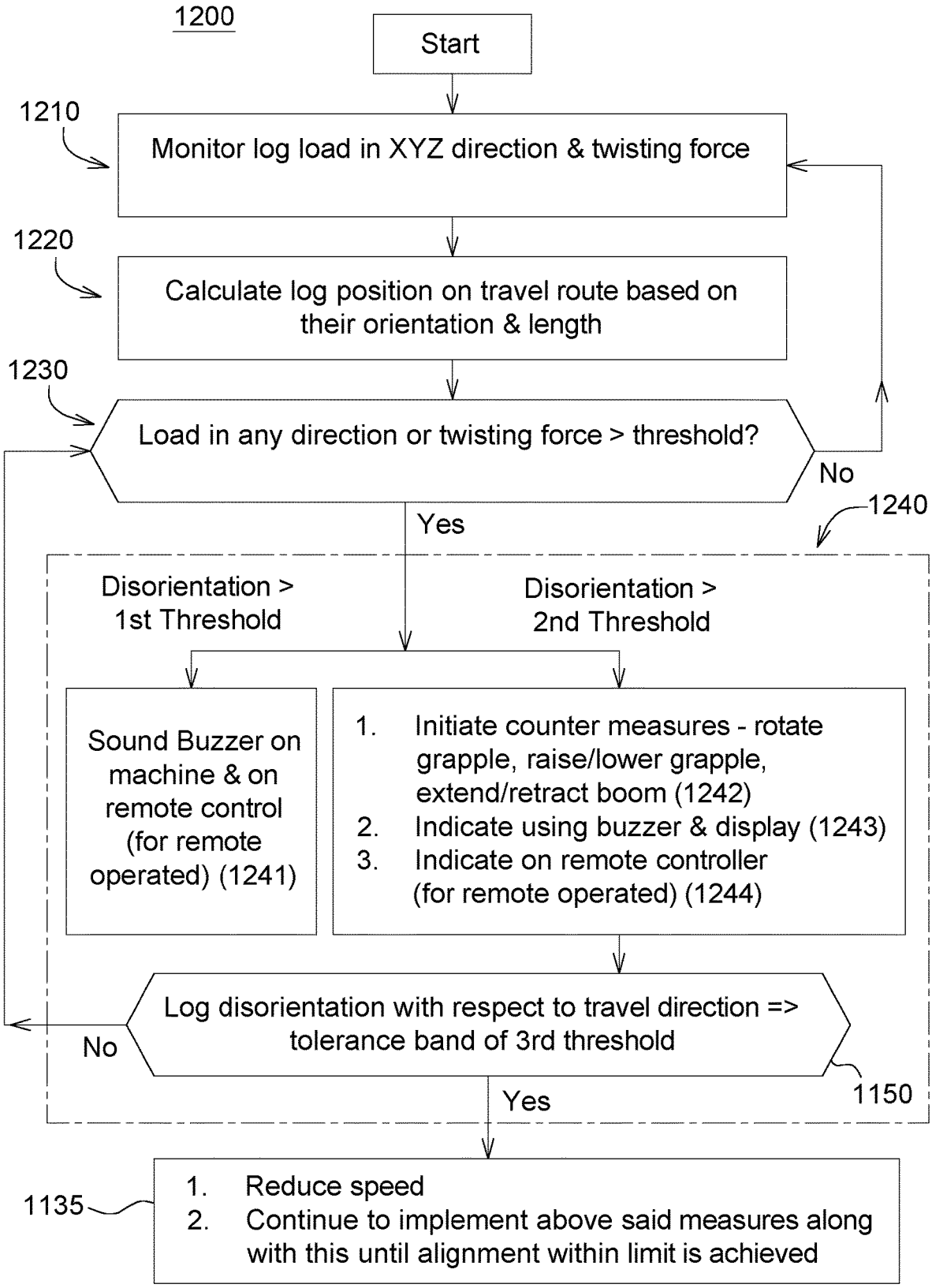
FIG. 17 is a generic flowchart of the dynamic assist system according to a second embodiment.

Now turning to FIGS. 16 and 17, a method (1100, 1200) of dynamically adjusting the position of a grapple 107 relative to the frame 130 of a work machine 100 is shown. The grapple 107 is pivotally suspended from a boom assembly 110 supported by the frame 130. The grapple 107 grasps felled trees for transport from a worksite. In steps 1110 and 1210, the method comprises monitoring a grapple position relative to the frame of the work machine. Steps 1120 and 1220 disclose monitoring a grapple orientation relative to the frame 130 of the work machine 100 and a direction of travel. This enables calculating the log position on travel path on the orientation of and length of the payload. Steps 1130 and 1230 disclose calculating a load vector 1008 of the payload on the work machine which may include one or more of the payload disorientation relative to the travel direction 1012, and determining whether a twisting force is greater than a threshold. Upon exceeding the threshold 1014, the method then selects a countermeasure (1131-1134, 1241-1244) to align the load vector with the direction of travel within a predetermined threshold, and execute the countermeasure. The countermeasure may comprise one or more of raising or lowering the boom assembly relative to the frame; extending or retracting the boom assembly relative to the frame; rotating a grapple orientation relative to the frame; changing a speed of travel of the work machine; changing a path of travel of the work machine; and alerting the operator if the load vector exceeds the predetermined threshold.

The terminology used herein is for the purpose of describing particular embodiments or implementations and is not intended to be limiting of the disclosure. As used herein, the singular forms "a", "an" and "the" are intended to include the plural forms as well, unless the context clearly indicates otherwise. It will be further understood that the any use of the terms "has," "have," "having," "include," "includes," "including," "comprise," "comprises," "comprising," or the like, in this specification, identifies the presence of stated features, integers, steps, operations, elements, and/or components, but does not preclude the presence or addition of one or more other features, integers, steps, operations, elements, components, and/or groups thereof.

The references "A" and "B" used with reference numerals herein are merely for clarification when describing multiple implementations of an apparatus.

One or more of the steps or operations in any of the methods, processes, or systems discussed herein may be omitted, repeated, or re-ordered and are within the scope of the present disclosure.

While the above describes example embodiments of the present disclosure, these descriptions should not be viewed in a restrictive or limiting sense. Rather, there are several variations and modifications which may be made without departing from the scope of the appended claims

What is claimed is:

1. A work machine having an intelligent assist system, the work machine comprising:

a frame and a ground-engaging mechanism, the ground-engaging mechanism coupled to support the frame on a surface;

a boom assembly coupled to the frame wherein the boom assembly includes:

a first section pivotally coupled to the frame and moveable relative to the frame by a first actuator, a first boom position sensor coupled to the first section, and a second section pivotally coupled to the first section and moveable relative to the first section by a second actuator, a second boom position sensor coupled to the second section; and a grapple pivotally suspended from the second section at a location distal from the first section, the grapple rotatable relative to the frame by a third actuator, the grapple configured to engage a payload;

a load measuring device coupled to the boom assembly and the grapple, the load measuring device configured to generate a load signal indicative of a magnitude of the payload;

an angle measuring device coupled to the boom assembly and the grapple, the angle measuring device configured to generate an orientation signal indicative of an orientation of the payload relative to the frame; and a controller coupled to the boom assembly, the controller comprising a memory that stores computer-executable instructions and a processor that executes the instructions to:

monitor a first position signal from the first boom position sensor, a second position signal from the second boom position sensor, the load signal, and the orientation signal;

calculate a load vector based on the load signal and the orientation signal, generate a disorientation signal based on the load vector and a direction of travel;

determine if the disorientation signal is outside a predetermined threshold, and actuate one or more of the first actuator, the second actuator, the third actuator and the ground engaging mechanism if the disorientation signal exceeds the predetermined threshold to reorient one or more of the payload and the work machine position relative to the payload.

2. The work machine of claim 1 further comprising:

a pin coupled to the second section at a location distal from the first section, the pin having a first envelope of movement throughout which the pin is moveable; and the controller further calculating a map of hydraulic capacities within an envelope of movement for one or more of the first and the second actuators based on the first position signal, the second position signal, the load signal, and the orientation signal; and generating a second movement envelope of the pin through at least a portion of the first envelope based on the hydraulic capacities, the second movement envelope being smaller than the first envelope.

3. The work machine of claim 2, wherein the map of hydraulic capacities comprises a series of nodes representing the hydraulic capacities of one or more of the first and the second actuators throughout the first envelope in real-time.

4. The work machine of claim 3, wherein the second movement envelope comprises a lift path of the pin from a first pin position to a second pin position through nodes of the series of nodes with sufficient hydraulic capacity.

5. The work machine of claim 1, wherein the controller actuates a change in one or more of a travel speed and a travel path if the disorientation signal exceeds the predetermined threshold.

6. The work machine of claim 1 wherein the predetermined threshold comprises of a first predetermined threshold actuating a first response, and a second predetermined threshold actuating a second response.

7. The work machine of claim 1 wherein the controller initiates an alert when a magnitude of the load vector exceeds the predetermined threshold.

8. The work machine of claim 1 further comprises a communication portal for communicatively coupling the controller to a remote controller, wherein an operator may view the disorientation signal on a display and actuate one or more of the first actuator, the second actuator, the third actuator and the ground-engaging mechanism to realign the payload within the predetermined threshold.

9. The work machine of claim 1, wherein a grapple suspension coupling comprises a crosshead assembly, the crosshead assembly including a boom stopper for limiting a free-range motion of the grapple.

10. A skidder having an intelligent assist system, the skidder comprising:

a frame extending in fore-aft direction, a ground-engaging mechanism coupled to the frame to support the frame on a surface;

a boom assembly coupled to the frame wherein the boom assembly includes:

an arch section pivotally coupled to the frame and movable relative to the frame by a pair of arch actuators, a boom section pivotally coupled to the arch section and the frame, the boom section moveable relative to the first section by a pair of boom actuators;

a grapple pivotally suspended from the boom section at a location distal from the arch section, the grapple rotatable relative to the frame by a grapple actuator, the grapple configured to engage a payload;

a first rotation angle sensor at an arch-boom pivotal coupling, the first rotation angle sensor measuring a boom assembly position in an x-y plane wherein the x-axis extends in a fore-aft direction and the y-axis extends in the vertical direction;

a second rotation angle sensor in a first location at a boom-grapple pivotal coupling, the second rotation angle sensor measuring a boom assembly position in an x-z plane;

a load measuring device in a second location at the boom-grapple pivotal coupling; and a controller coupled to the boom assembly, the controller comprising a memory that stores computer-executable instructions and a processor that executes the instructions to:

monitor a first rotation angle signal from the first rotation angle sensor, a second rotation angle signal from the second rotation angle sensor, and a load signal from the load measuring device;

calculate a load vector based on the first rotation angle signal, the second rotation angle signal, and the load signal;

determine if the load vector falls outside predetermined limits in one or more of the x, y and z direction, and perform one or more actions based on the load vector.

11. The skidder of claim 10, wherein the action comprises actuating the arch actuators to extend or retract the grapple.

12. The skidder of claim 10, wherein the action comprises actuating the boom actuators to raise or lower the grapple.

13. The skidder of claim 10, wherein the action comprises actuating the grapple actuator to rotate the grapple.

14. The skidder of claim 10, wherein the action comprises modifying one or more of the speed and a travel path of the skidder.

15. The skidder of claim 10, wherein the action comprises alerting an operator upon reaching a first threshold and performing a second action upon reaching a second threshold.

16. The skidder of claim 10, wherein the boom-grapple pivotal coupling comprises a crosshead assembly, the crosshead assembly including boom stoppers for limiting a free-range motion of the grapple.

17. A method of dynamically adjusting a grapple position relative to a frame of a work machine, using a grapple pivotally suspended from a boom assembly supported by the frame, the frame supported by a ground-engaging mechanism, wherein the grapple grasps felled trees for transport from a worksite, the method comprising:

monitoring the grapple position relative to the frame of the work machine;

monitoring a grapple orientation relative to the frame of the work machine;

monitoring a direction of travel of the work machine;

calculating a load vector of a payload on the work machine;

determining a load vector orientation relative to the direction of travel;

selecting a countermeasure to align the load vector with the direction of travel within a predetermined threshold, and executing the countermeasure.

18. The method of claim 17 wherein calculating the load vector is derived from a load measuring device coupled to the grapple, the load measuring device generating a load signal indicative of a magnitude of the payload; and an angle measuring device coupled to the grapple, the angle measuring device generating an orientation signal indicative of an orientation of the payload relative to the frame.

19. The method of claim 17 wherein monitoring the grapple position relative to the frame comprises:

receiving a first position signal generated from a first boom position sensor on a first section of the boom assembly, and receiving a second position signal generated from a second boom position sensor on a second section of the boom assembly.

20. The method of claim 17, wherein the countermeasure comprises one or more of:

raising or lowering the boom assembly relative to the frame;

extending or retracting the boom assembly relative to the frame;

rotating the grapple orientation relative to the frame;

changing a speed of travel of the work machine;

changing the direction of travel of the work machine; and alerting an operator if the load vector exceeds a predetermined threshold.

* * * * *